US010589184B2

(12) United States Patent
Mowbray

(10) Patent No.: US 10,589,184 B2
(45) Date of Patent: Mar. 17, 2020

(54) GAS INFLATABLE BALLOONS

(71) Applicant: Creative Impact Inc., Road Town, Tortola (VG)

(72) Inventor: Mathew Peter Mowbray, Cambridge (NZ)

( * ) Notice: Subject to any disclaimer, the term of this patent is extended or adjusted under 35 U.S.C. 154(b) by 0 days.

(21) Appl. No.: 15/953,912

(22) Filed: Apr. 16, 2018

(65) Prior Publication Data

US 2018/0296935 A1 Oct. 18, 2018

Related U.S. Application Data

(63) Continuation-in-part of application No. 15/478,567, filed on Apr. 4, 2017, now Pat. No. 9,962,619.

(30) Foreign Application Priority Data

Apr. 4, 2016 (NZ) ..... 718690
Dec. 23, 2016 (NZ) ..... 727945

(51) Int. Cl.
*A63H 3/06* (2006.01)
*A63H 27/10* (2006.01)

(52) U.S. Cl.
CPC ..... *A63H 27/10* (2013.01); *A63H 2027/1033* (2013.01); *A63H 2027/1041* (2013.01); *A63H 2027/1075* (2013.01); *A63H 2027/1083* (2013.01); *A63H 2027/1091* (2013.01)

(58) Field of Classification Search
CPC .. A63H 27/10; A63H 2027/1041; A63H 3/06; A63H 2027/1033; A63H 23/10; A63H 2027/1083; A63H 27/04; A63B 2225/62
USPC ..... 446/181, 202, 220, 222, 224–226
See application file for complete search history.

(56) References Cited

U.S. PATENT DOCUMENTS 262,517 A 8/1882 Unz et al.
4,516,949 A * 5/1985 Schwartz ..... A63H 27/10 446/222
4,560,360 A 12/1985 Isaacs et al.
4,721,491 A 1/1988 Buchanan
4,911,674 A 3/1990 Cole
5,029,851 A 7/1991 Hagen
5,049,106 A 9/1991 Kim et al.
5,165,393 A * 11/1992 Kawaguchi ..... A63B 23/18 128/200.24
5,234,726 A * 8/1993 Dahan ..... B42D 15/045 229/923
5,245,991 A 9/1993 Kawaguchi
5,306,194 A 4/1994 Epstein
5,496,203 A * 3/1996 Murray ..... A63H 27/10 446/221
6,478,651 B1 11/2002 Weir
6,702,699 B2 3/2004 Touhey et al.
(Continued)

OTHER PUBLICATIONS

Australian Patent Office, Written Opinion of the International Searching Authority, PCT/IB2017/051900, dated May 30, 2017, pp. 1-6.
(Continued)

*Primary Examiner* — Nini F Legesse
(74) *Attorney, Agent, or Firm* — Dentons US LLP

(57) ABSTRACT

A tethered balloon assembly the balloon, to be inflated via the tether which is to be subsequently closed by a one way valve to keep the balloon inflated and allow additional inflation as desired, controllable by its tether.

20 Claims, 24 Drawing Sheets

(56) References Cited

U.S. PATENT DOCUMENTS

| | | | | |
|---|---|---|---|---|
| 8,789,565 | B1 | 7/2014 | Wicken | |
| 9,051,066 | B1 * | 6/2015 | Malone | A61J 1/10 |
| 9,315,282 | B2 | 4/2016 | Malone | |
| 2006/0291217 | A1 | 12/2006 | Vanderschuit | |
| 2008/0265086 | A1 | 10/2008 | Lee | |
| 2009/0047864 | A1 * | 2/2009 | Burchett | A63H 27/10<br>446/224 |
| 2011/0151744 | A1 * | 6/2011 | Archer | A63H 27/10<br>446/222 |
| 2013/0118640 | A1 | 5/2013 | Saggio | |
| 2013/0296140 | A1 * | 11/2013 | Publicover | A63B 41/00<br>482/77 |
| 2014/0030452 | A1 * | 1/2014 | Warner | A63H 27/10<br>428/34.1 |
| 2014/0295728 | A1 | 10/2014 | Cayton | |
| 2016/0039547 | A1 | 2/2016 | Malone | |
| 2017/0282088 | A1 | 10/2017 | Mowbray | |

OTHER PUBLICATIONS

Search Report of European Patent Office in Appl'n No. EP18204191.3, dated May 24, 2019.
U.S. Appl. No. 16/179,680.

* cited by examiner

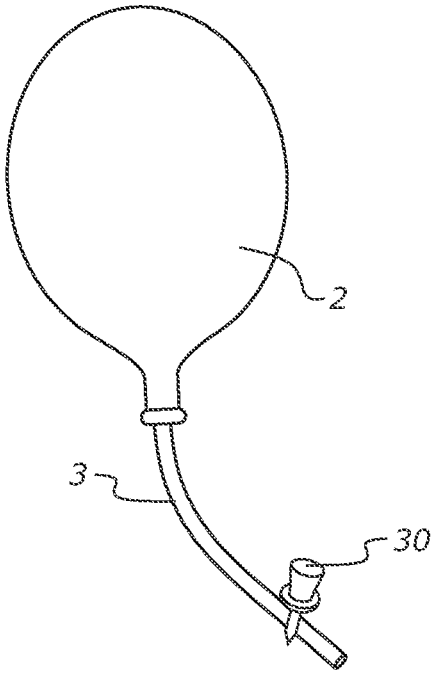
FIG. 8
FIG. 9
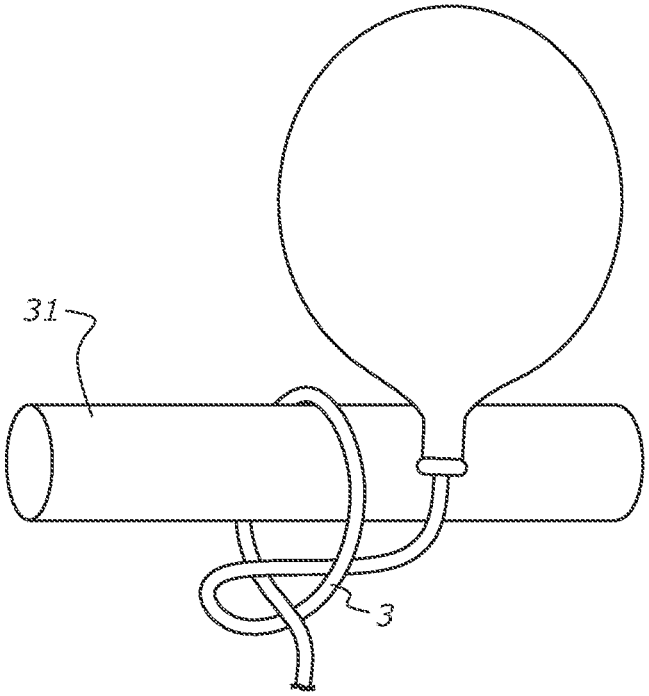

GAS INFLATABLE BALLOONS

CROSS-REFERENCE TO RELATED APPLICATION

This application is a continuation-in-part of U.S. application Ser. No. 15/478,567, filed Apr. 4, 2017, the entirety of which is incorporated herein by reference.

FIELD OF THE INVENTION

The present invention relates to gas inflatable balloons.

DESCRIPTION OF THE RELATED ART

Inflating of balloons (such as party balloons) from a flaccid state with gas can be time consuming. Inflation is typically done by placing a person's mouth on the spout of a balloon and breathing air into the balloon. The spout of the inflated balloon is then sealed, normally by the person tying a knot in the spout. This can be difficult if the spout is very inelastic or short. Often party balloons are displayed by anchoring them to ceilings or walls of the like. Mostly they will hang from their anchor point unless filled with a gas lighter than air. The anchoring of a balloon usually requires the tying of a string to the spout of the balloon. The string is then tied or pinned at or near its free end to anchor the balloon in place. This adds further time to the process of displaying inflated balloons at a party or other function. For parties and other functions a large number of balloons often need to be inflated, sealed and anchored. The process of inflating, sealing and anchoring balloons can hence take a long time. It is accordingly an object of the present invention to provide gas inflatable balloons that are able to be inflated, sealed and anchored in a manner that at least overcomes some of the above mentioned disadvantages.

BRIEF SUMMARY OF THE INVENTION

The present invention recognises the prospects of providing as a marketable item an assembly able to simultaneously inflate each of a plurality of inflatable balloons via a dedicated inflation conduit which is able, post inflation of its balloon, to provide a tether of the inflated balloon.

In a first aspect the invention may broadly be said to be a balloon inflation system for simultaneously inflating a plurality of balloons, the system comprising of a plurality of balloon and tether assemblies the tether of each balloon being flexible and also being an inflation conduit for delivery of inflation gas to the balloon, each tether has (a) a first open end inserted into a respective balloon at the spout of the balloon and the balloon is bonded at the spout to the tether in a sealed manner to ensure that inflation gas can only enter the balloon via the tether (b) a second open end remote from the balloon, the second open end of the tether is fluidly connected to a manifold to which each tether is fluidly connected the manifold able to receive an inflation gas for delivery of said inflation gas via the manifold to each of said tethers and respective balloons, each tether, post inflation able to be severed to remove the balloon and tether assembly from the manifold, wherein a one way valve is associated with said tether to control the flow of gas through said tether, the valve is passive to self-seal the tether when the gas pressure inside the balloon exceeds the gas pressure in the tether and wherein the tethers are severably joined in an adjacent manner along at least part of their lengths to form a ribbon of tethers in a manner to be able to separate from each other.

Preferably the valve is located inside the balloon at the first open end of the tether at the balloon.

Preferably the valve is a duckbill valve.

In a second aspect the present invention may be said to be a method of providing a plurality of simultaneously inflated balloons, each with a flexible tether, said method comprising or including the steps of a) supplying an inflation gas into a manifold via which an associated flexible inflation conduit for and passing into each balloon receives inflation gas to be delivered to each respective balloon, and b) post inflation of each balloon via its inflation conduit, allowing self-sealing of each such inflation conduit utilising a duckbill valve for each inflation conduit in a manner to prevent deflation of its attached inflated balloon and to leave each such conduit as a said tether of its respective balloon.

Also herein described is a gas inflatable balloon with a tether, the tether used for the inflation of the balloon.

Also herein described is a balloon and tether assembly the tether being an inflation conduit for the balloon.

Preferably the tether is a conduit and is able to deliver gas from a gas source into the balloon to cause the balloon to be inflated.

Preferably gas is able to be introduced by the tether into the balloon via a spout of the balloon.

Preferably said gas is able to be introduced into the balloon only at the spout of the balloon.

Preferably the tether is inserted into the balloon at the spout of the balloon.

Preferably the balloon is bonded at the spout to the tether in a sealed manner. This preferably ensures that gas can only leave and/or enter the balloon via the tether.

Preferably the spout is bonded about the tether at the spout.

Preferably an adhesive is used to bond the balloon at the spout to the tether.

Preferably the adhesive is applied in a flowable state and is or is able to be caused to bead-up across the spout to seal the spout to the tether and to itself. Preferably the bead is on the inside of the balloon.

Preferably the tether and balloon are heat welded to each other at the spout to bond the tether and balloon together.

Preferably a choker is provided to hold the tether in a sealed manner to said balloon at the spout of the balloon.

Preferably the choker is part of the balloon.

Preferably the choker is a separate item to said balloon.

Preferably the choker is an elastic band.

Preferably the choker holds the tether and balloon in a non-disassociatable condition.

Preferably the sealed relationship between the balloon and the tether is established by one of a weld formed at the spout of the balloon around the tether, the gluing of the spout of the balloon around tether and an O-ring provided around both the spout of the balloon and the tether.

Preferably the tether is a conduit such as a hollow flexible tube.

Preferably the conduit has a first open end opening in the balloon and a second open end remote from the balloon.

Preferably the conduit is flexible, in order to be able to bend, between its first and second open ends.

Preferably the conduit is flexible along its entire length between the first and second open ends.

Preferably the tether is able to be coiled up without closing its internal passage.

Preferably the tether is able to be bent, closing its internal passage yet be un-bent and reopen its internal passage.

Preferably tether will not inflate (it is of a constant passage cross section before, during and after inflation).

Preferably the conduit is adapted and configured to not inflate when inflating the balloon.

Preferably the tether is a hollow tube.

Preferably the tether is a tube of OD of less than 4 mm and preferably less than 2 mm and preferably less than 1 mm.

Preferably the tether is of a bendable plastic material.

Preferably the tether is of a constant cross sectional profile between its first and second open end and preferably substantially along its entire length.

Preferably the tether provides or has provided a duct for gas to (be) delivered from its end remote the balloon and into the balloon.

Preferably the tether is at least 10 cm long.

Preferably the tether is at least 50 cm long.

Preferably the tether is at least 80 cm long.

Preferably the tether is between 30 cm to 120 cm long, and optionally 50 cm to 100 cm long.

Preferably the balloon is made of an elastic material.

Preferably the balloon is made of a latex or polychloroprene based material.

Preferably the balloon is of an inelastic material.

Preferably the balloon is made of a foil material.

Preferably the balloon is, when flaccid, of volume less than 20% the volume when inflated.

Preferably the balloon is or is able to be inflated to retain a volume of gas of at least 0.5 litres.

Preferably the balloon is or is able to be inflated to retain a volume of gas of at least 2 litres.

Preferably the balloon is or is able to be inflated to retain a volume of gas of at least 10 litres.

Preferably the balloon is or is able to be inflated to retain a volume of gas of at least 30 litres.

Preferably the balloon can be inflated to retain a volume of gas of no more than least 40 litres.

Preferably the balloon can be inflated to retain a volume of gas of no more than 40 litres.

Preferably the balloon can be inflated to retain a volume of gas of no more than 30 litres.

Preferably the balloon be inflated to retain a volume of gas of no more than 20 litres.

Preferably the balloon can be inflated to retain a volume of gas of no more than 10 litres.

Preferably the balloon can be inflated to retain a volume of gas of no more than 5 litres.

Preferably the balloon can be inflated to retain a volume of gas of no more than 2 litres.

Preferably the balloon can be inflated to retain a volume of gas of no more than 1 litres.

Preferably the balloon can be inflated to retain a volume of gas of no more than 0.5 litres.

Preferably the second open end of the tether may be a free open end or a connected open end.

Preferably the second open end of the tether is fluidly connected or connectable to a manifold (e.g. a manifold conduit) to which a plurality of like tethers and respective balloons are fluidly connected in series or in parallel.

Preferably the manifold has an open end fluidly connected or able to be fluidly connected directly or indirectly to a pump or source of pressurised gas (e.g. a gas bottle).

Preferably a plurality of tethers are each connected at their respective second open ends to said manifold so as to allow all balloons to be inflated simultaneously by gas passing via the balloon's respective tethers, via the manifold conduit.

Preferably the plurality of tethers are connected to the manifold in a spaced apart manner.

Preferably the space between adjacent connections of tethers with the manifold it at least 5 cm and preferably at least 10 cm and preferably at least 20 cm and preferably at least 30 cm and preferably at least 50 cm and preferably at least 100 cm and preferably at least 150 cm.

Preferably the second open end of the tether is fluidly connected or able to be fluidly connected directly or indirectly to a pump or source of pressurised gas (e.g. a gas bottle).

Preferably the second open end is connected or connectable to a housing (preferably a manifold) having a gas inlet to connect or connected to a pump or source of pressurised gas and at least one gas outlet at where said second open end is/can be fluidly connected.

Preferably the housing has a plurality of gas outlets, a plurality of tethers and respective balloons in gas connection with said housing via a respective said gas outlet.

Preferably the tether at its second open end is permanently attached to a said second gas outlet.

Preferably the tether at its second open end is releasable attached to a said second gas outlet.

Preferably the plurality of gas outlets are able to be selectively sealed.

Preferably each tether of the plurality of tethers is able to be sealed to prevent or restrict gas escaping the balloon via the tether, and this sealing is independent of sealing of any of the other tethers. Preferably said selective sealing is able to be achieved by a finger of a user.

Preferably the selective sealing is able to be achieved by a plug.

Preferably the plug can seal a plurality of gas outlets simultaneously.

Preferably the plug can seal all but one gas outlet simultaneously.

Preferably the balloon and the tether are made from different materials.

Preferably the assembly includes said housing.

Preferably the housing is provided in a retail pack or kit of parts with said balloon and tether assembly.

Preferably the retail pack or kit of parts comprises a plurality of balloon and tether assemblies.

Preferably the retail pack or kit or parts comprises a plurality of balloon and tether assemblies, each tether at its second outlet opening connected to a respective gas outlet of said housing.

Preferably the retail pack or kit of parts comprises a plurality of balloon and tether assemblies, each tether at its second outlet opening to be connected to a respective gas outlet of said housing by the end user.

Preferably the retail pack or kit of parts includes a pump.

Preferably the tether is able to be sealed to prevent or restrict gas escaping the balloon via the tether.

Preferably each tether of the plurality of tethers is able to be sealed to prevent or restrict gas escaping the balloon via the tether, and this sealing is independent of sealing of any of the other tethers.

Preferably the tether is able to be sealed at a location at or between its first and second open ends.

Preferably a valve is associated with said tether to control the flow of gas through said tether.

Preferably the valve is manually actuable to seal the tether.

Preferably the valve is a one way valve.

Preferably the valve is self-sealing.

Preferably the valve is passive and seals the tether when the gas pressure inside the balloon exceeds the gas pressure in the tether.

Preferably the valve is located inside the balloon at or near the first open end of the tether.

Preferably the valve is located at the first open end of the tether.

Preferably the valve is located at the spout of the balloon and preferably the tether does not enter the balloon other than optionally at the spout.

Preferably the spout and the valve are bonded or otherwise held together to create a seal there between.

Preferably the valve is a duckbill valve.

Preferably the duckbill valve is operative at the first open end of the tether to prevent or restrict gas leaving the balloon through the first open end and tether.

Preferably the duckbill valve comprises two plies of film laminated to each other save for a sealable passage therethrough, said tether partially located in a sealed manner in said passage to present the first open end between the ends of the passage, the part of the passage between the end of the passage and the first opening able to collapse so as to seal the passage.

Preferably the duckbill valve comprises two plies of material joined with one another to define a sealable passage therethrough, the tether being inserted into the passage with its exterior sealed against the plies or sheets to close off a first end of the passage and to present the first open end of the tether inside the passage, wherein the passage is able to collapse so as to seal the passage about the first open end of the tether.

Preferably the plies are made from a film or sheet material, or materials, with a capacity to develop and hold an electrostatic charge.

Preferably the plies are of polyurethane, polyester, polypropylene or PVC materials.

Preferably each of the plies are of the same material.

Preferably each of the plies are of a different material.

Preferably each of the plies are of different materials, being materials which are separated from one another in the triboelectric series.

Preferably at least the inner surfaces of the plies which contact one another to seal the passage about the first open end of the tether have a roughened surface texture.

Preferably the tether extends into the balloon sufficiently to position the duckbill valve completely inside the balloon.

Preferably the tether is able to be sealed to prevent or restrict gas escaping the balloon, by a knot able to be or pre-tied but not drawn taut, in the tether.

Preferably the tether has a slack knot formation provided at a location along its length.

Preferably the tether is able to be sealed to prevent or restrict gas escaping, by a choker about the tether.

Preferably the tether is able to be cut by scissors or torn to split the tether into two parts.

Preferably the tether is of a material able to be cut by scissors or torn to split the tether into two parts.

In yet a further aspect the present invention may be said to be a plurality of balloon and tether assemblies as herein before described.

Preferably the plurality tethers are connected to each other between their ends.

Preferably the plurality of tethers are connected to each other long at least parts of their length.

Preferably the plurality of tethers are at least partially and preferably completely severably connected to each other.

Preferably the plurality of tethers are connected to each other to form a ribbon like arrangement of connected tethers.

Preferably the tethers are connected to each other along their elongate direction and parallel to each other to define a ribbon of a plurality of tethers.

Preferably said plurality of balloon and tether assemblies are inside a retail pack.

Also herein described is a retail pack comprises a plurality of balloon and tether assemblies as herein before described.

Preferably the retail pack comprises a plurality of balloon and tether assemblies, each tether at its second outlet opening connected to a respective gas outlet of said housing.

Preferably the retail pack comprises a plurality of balloon and tether assemblies, each tether at its second outlet opening to be connected to a respective gas outlet of said housing by the end user.

Preferably the retail pack includes a pump.

Preferably the tethers are able to be compressed by a finger of the user to be able to control gas flow via an individual tether.

Also herein described is a marketable item or kit or parts comprising or including:

a) a manifold adapted to receive or for receiving inflation gas for a plurality of balloons, b) an inflation conduit (preferably a tube) for each balloon of the plurality of balloons to receive or for receiving the inflation gas from the manifold, and said plurality of balloons, each of the balloons being attached with its spout about and to its respective inflation conduit;

wherein each inflation conduit has an associated one way valve that is adapted to enable post inflation use closure of the conduit to prevent deflation of its attached inflation balloon, and wherein each such inflation conduit post closure will provide a tether for its attached inflated balloon.

Preferably each inflation conduit has an associated one way valve that is adapted to enable post inflation use closure of the conduit to prevent deflation of its attached inflation balloon, said one way valve adapted to close its associated inflation conduit independently of the other inflation conduits of the item.

Preferably the manifold has a connection for connecting to an inflation gas supply.

Preferably each inflation tube is formed from a flexible material.

Preferably the tether is inserted into the balloon at the spout of the balloon.

Preferably the balloon is sealed at the spout and about the conduit.

Preferably an adhesive is used to seal the balloon at the spout and to the conduit.

Preferably only one manifold is provided via which all balloons are able to be inflated.

Also herein described is a tethered balloon assembly the balloon, to be inflated via the tether which is to be subsequently closed by a one way valve to keep the balloon inflated and allow additional inflation as desired, controllable by its tether.

Preferably the inflation tube is inserted inside the balloon via the spout of the balloon.

Preferably the assembly comprises a plurality of balloons, each inflated via by a tether in fluid communication with the other tethers of the assembly, wherein each tether has an associated one way valve that operates independently to control inflation of its respective balloon.

Also herein described is a manifold and plurality of inflation conduit emergent from the manifold, each of the manifold and plurality of inflation conduits to pass a gas to be supplied to the manifold;

wherein each inflation conduit feeds to an attached balloon;

and wherein if the manifold or each inflation conduit is closed to gas flow post inflation of its attached balloon, the inflation conduit or part of the inflation conduit of each balloon, on detachment from the manifold, can act as a tether for its inflated balloon.

Preferably each inflation conduit is releasably attached to the manifold.

Preferably each balloon may be detached from the manifold by severing the conduit.

Preferably each inflation conduit can be cut or severed to separate each balloon from the manifold.

Preferably the inflation conduit is inserted inside the spout of the balloon.

Preferably a one way valve is provided between the balloon and the inflation conduit to seal the inflation conduit to flow of gas out of the balloon.

Preferably the manifold has a connection for connecting to an inflation gas supply.

Preferably the connection is a threaded connection.

Preferably each inflation conduit is formed from a sufficiently flexible material as to allow a hand or finger applied crimping force on the inflation tube to close the inflation tube.

Preferably the conduits are emergent from the manifold in a common direction.

Preferably the conduits are emergent from a common region of the manifold.

Preferably the conduits extend from the manifold in an adjacent manner to each other.

Preferably the conduits are joined to each other along part of their lengths.

Preferably the conduits are emergent from the manifold in a plurality of directions.

Preferably each inflation conduit has an associated valve that is adapted to enable post inflation use closure of the conduit to prevent deflation of its attached inflation balloon, said valve being configured to close its associated inflation conduit independently of the other inflation conduits of the item.

Also herein described is an item of manufacture comprising or including a) an inflatable balloon with a spout defining an inflation entrance for the balloon, and b) an inflation conduit about which the spout of the balloon is sealed;

wherein the inflation conduit is closable or is to be closable post its use for inflation of its balloon to thereafter act as a tether of or for the inflated balloon.

Also herein described is a method of providing a plurality of simultaneously inflated balloons, each with a tether, said method comprising or including the steps of 1) supplying an inflation gas into a manifold via which an inflation conduit for and passing into each balloon receives inflation gas to be delivered to each respective balloon, and 2) post inflation of each balloon via its inflation conduit, closing each such inflation conduit in a manner to prevent deflation of its attached inflated balloon and to leave each such conduit as a said tether of its respective balloon.

Preferably each inflation conduit is closed by a one way valve.

Preferably each inflation conduit is closed by tightening a knot provided in the inflation tube.

Preferably the one way valve is as herein before described.

Preferably the inflation conduits are in releasable connection with the manifold.

Preferably each inflation conduit is able to remain attached or be reattached to said manifold to allow a re-inflation of its associated the balloon or additional inflation of the balloon after first inflation.

Also herein described is a method of providing a string of a plurality of preferably simultaneously inflated balloons said method comprising or including the steps of 1) supplying an inflation gas into a (preferably flexible) manifold conduit along and from which, at spaced intervals, a plurality of (preferably flexible) branch inflation conduits extend that each pass into a respective balloon to deliver said inflation gas to a respective said balloon, and 2) post inflation of each balloon via its branch inflation conduit, closing each such branch inflation conduit in a manner to prevent deflation of its attached inflated balloon and to leave each such branch conduit and manifold conduit as a tether for the balloons.

Preferably said closing occurs by reducing the gas pressure delivered so said manifold conduit, to cause a duckbill valve associated with each said branch inflation conduits to seal under the influence of gas pressure in said balloon acting on said duckbill valve.

In yet another aspect the invention broadly involves the use 1) of a balloon tether as the conduit by which its connected balloon is to be gas inflated, and 2) of the balloon tether's closure to prevent balloon deflation.

In some embodiments the inflation conduit carries a one way valve that can prevent balloon deflation.

In other embodiments a loose knot of each inflation conduit can be tightened to form the closure. In other embodiments a crimping force may be provided to the inflation conduit to provide the closure, or an externally provided crimping component may provide a crimping force to the inflation conduit to form the closure.

Preferably tether is able to be sealed to prevent gas escaping the balloon, at a location intermediate the balloon and the end distal the balloon.

Preferably tether is able to be sealed to prevent gas escaping the balloon, at the balloon.

Preferably the tether is able to be sealed to prevent gas escaping, by a knot able to be or pre-tied but not drawn taut, in the tether.

Preferably the tether has a slack knot formation provided at a location along its length.

Preferably the tether is able to be sealed to prevent gas escaping, by a choker about the tether.

Also herein described is a marketable item comprising or including:

a) a manifold adapted to receive or for receiving inflation fluid for a plurality of balloons, b) an inflation conduit (preferably a tube) for each balloon of the plurality of balloons to receive or for receiving the inflation fluid from the manifold, and said plurality of balloons, each of the balloons being attached with its mouth about its respective inflation tube;

wherein each inflation conduit is adapted to enable its post inflation use closure to prevent deflation of its attached inflation balloon, by one of a weld closure, knot closure, crimping closure choke closure or the like;

and wherein each such inflation conduit post closure will provide a tether for its attached inflated balloon.

Preferably the manifold has a connection for connecting to an inflation fluid supply.

Preferably each inflation tube is formed from a sufficiently flexible material as to allow a crimping force on the tube to create a closure in the tube.

Preferably each inflation tube has a knot formation provided between the manifold and the balloon sufficiently slack such that the knot does not form a closure in the inflation tube yet can be pulled taught to create the closure.

Preferably a tightening of the knot of each inflation tube post its inflation use is such that it may cause a crimping force to be exerted on the inflation tube and forms a closure in the inflation tube to prevent said fluid escaping said balloon and tube.

Preferably a component is externally provided around at least a portion of the inflation tube such that the crimping of the component may form a closure in the inflation tube.

Preferably the conduit able to be cut or severed at a or any location between the manifold and the balloon.

Preferably the conduit at its end distal said balloon is secured to said manifold in a permanent manner.

Preferably the conduit at its end distal said balloon is secured to said manifold in a releasable manner.

Also herein described is a tethered balloon assembly the balloon to be inflated via the tether which is to be subsequently closed to keep the balloon inflated but controllable by its tether.

Also herein described is a manifold and plurality of inflation tubes emergent from the manifold, each of the manifold and plurality of inflation tubes to pass a fluid to be supplied to the manifold;

wherein each inflation tube provided for a feed of fluid to an attached balloon;

and wherein if the manifold of each inflation tube is closed post inflation of its attached balloon, the inflation tube or part of the inflation tube of each balloon, on detachment from the manifold or part of the inflation tube, can act as a tether for its inflated balloon.

In another aspect the invention can be said to be broadly described as a balloon and tether assembly comprising or including:

a plurality of inflatable balloons, each with a spout defining an inflation entrance for the balloon, and a plurality of inflation conduits for delivering inflation gas to said plurality of balloons, each of said inflation conduits extending between a first open end, about which the spout of a respective one of the balloons is sealed, and a second open end;

wherein each inflation conduit has an associated valve to close the conduit and prevent deflation of its associated balloon after inflation, said valve adapted to close its associated inflation conduit independently of the other inflation conduits of the assembly, and wherein each of said inflation conduits is flexible and elongate so as to be able to act as a tether of or for the balloon post-inflation.

In some embodiments each said balloon is bonded to a respective tether at its spout.

In some embodiments each inflation conduit is between 30 cm and 120 cm long, and optionally between 50 cm and 100 cm long.

In some embodiments each inflation conduit has an internal diameter of between 2 and 4 mm.

In some embodiments each valve is located inside of the balloon, at or near the first open end of the inflation conduit In some embodiments each valve is a one way valve and preferably a duck bill valve In some embodiments the valve is a duckbill valve comprising two plies of material joined with one another to define a sealable passage therethrough, the tether being inserted into the passage with its exterior sealed against the plies or sheets to close off a first end of the passage and to present the first open end of the tether inside the passage, and wherein the passage is able to collapse so as to seal the passage about the first open end of the tether.

In some embodiments said plurality of inflation conduits are connected to one another along at least a part or parts of their length.

In some embodiments the plurality of inflation conduits are at least partially and preferably completely severably connected to each other.

In some embodiments the plurality of inflation conduits are connected to one another along a portion of their elongate length, the connected inflation conduits being oriented parallel and adjacent to one another in a ribbon like formation.

In some embodiments the inflation conduits are connected in a manner that their second open ends are presented adjacent one another.

In some embodiments further comprising a manifold for the delivery of inflation gas, wherein said manifold is adapted to receive the second open end of each of the plurality of inflation conduits to facilitate simultaneous inflation of the plurality of balloons.

In some embodiments the second open ends are received at, and emergent from, a common region of the manifold, and are optionally emergent from the manifold in a common direction.

In another aspect the invention can be said to broadly consist in a method of providing a plurality of simultaneously inflated balloons, each having a tether, said method comprising or including the steps of:

a) supplying an inflation gas into a manifold via which a flexible, elongate inflation conduit for and passing into each balloon receives inflation gas to be delivered to each respective balloon, each of said balloons having a spout region defining an inflation entrance for the balloon which spout region is sealed about a first open end of a respective inflation conduit, and b) post inflation of each balloon via its inflation conduit, closing each such inflation conduit to prevent deflation of its attached inflated balloon and to leave each such conduit as a said tether of its respective balloon, wherein closing of each inflation conduit is effected by a valve adapted to close its associated inflation conduit independently of the other inflation conduits of the system.

In some embodiments each inflation conduit is between 30 cm and 120 cm long, and optionally between 50 cm and 100 cm long.

In some embodiments each valve is located inside of the balloon, at or near the first open end of the inflation conduit In some embodiments each inflation conduit has an internal diameter of between 2 and 4 mm.

In some embodiments each valve is located inside of the balloon, at or near the first open end of the inflation conduit In some embodiments each valve is a one way valve and preferably a duck bill valve In some embodiments the valve is a duckbill valve comprising two plies of material joined with one another to define a sealable passage therethrough, the tether being inserted into the passage with its exterior sealed against the plies or sheets to close off a first end of the passage and to present the first open end of the tether inside the passage, and wherein the passage is able to collapse so as to seal the passage about the first open end of the tether.

In some embodiments said plurality of inflation conduits are connected to one another along at least a part or parts of their length.

In some embodiments the plurality of inflation conduits are at least partially and preferably completely severably connected to each other.

In some embodiments the plurality of inflation conduits are connected to one another along a portion of their elongate length, the connected inflation conduits being oriented parallel and adjacent to one another in a ribbon like formation.

In some embodiments the inflation conduits are connected in a manner that their second open ends are presented adjacent one another.

In some embodiments said manifold is adapted to receive a second open end of each of the plurality of inflation conduits to facilitate supply of inflation gas, and wherein the second open ends are received at, and emergent from, a common region of the manifold, and are optionally emergent from the manifold in a common direction.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

BRIEF DESCRIPTION OF THE DRAWINGS

Reference will now be made to the accompanying drawings in which:

FIG. 6*b* shows the balloon having been deflated from its more inflated condition in FIG. 6*a* but gas being delivered via the tether into the balloon to re-inflate it and FIG. 6*c* illustrates the balloon in a re-inflated condition, FIG. 8 illustrates a balloon and tether assembly wherein a thumb tack or pin or other type of fastener can be used for anchoring the tether to a wall or ceiling or the like, FIG. 9 illustrates the tether being able to be tied in a knot about an object such as a handrail or the like, FIG. 10 shows a variation of the invention shown in FIGS. 1*a* and 1*b* wherein a manifold conduit is provided to which each of the tethers of a plurality of tether and balloon assemblies are engaged for the simultaneous filling of each of the balloons of the set via the manifold conduit from for example a hand pump also illustrated.

DETAILED DESCRIPTION OF THE INVENTION

Reference will now be made to various components and variations of such components at least some of which are shown in the accompanying drawings, that can be used for executing the present invention.

Figure 1A:
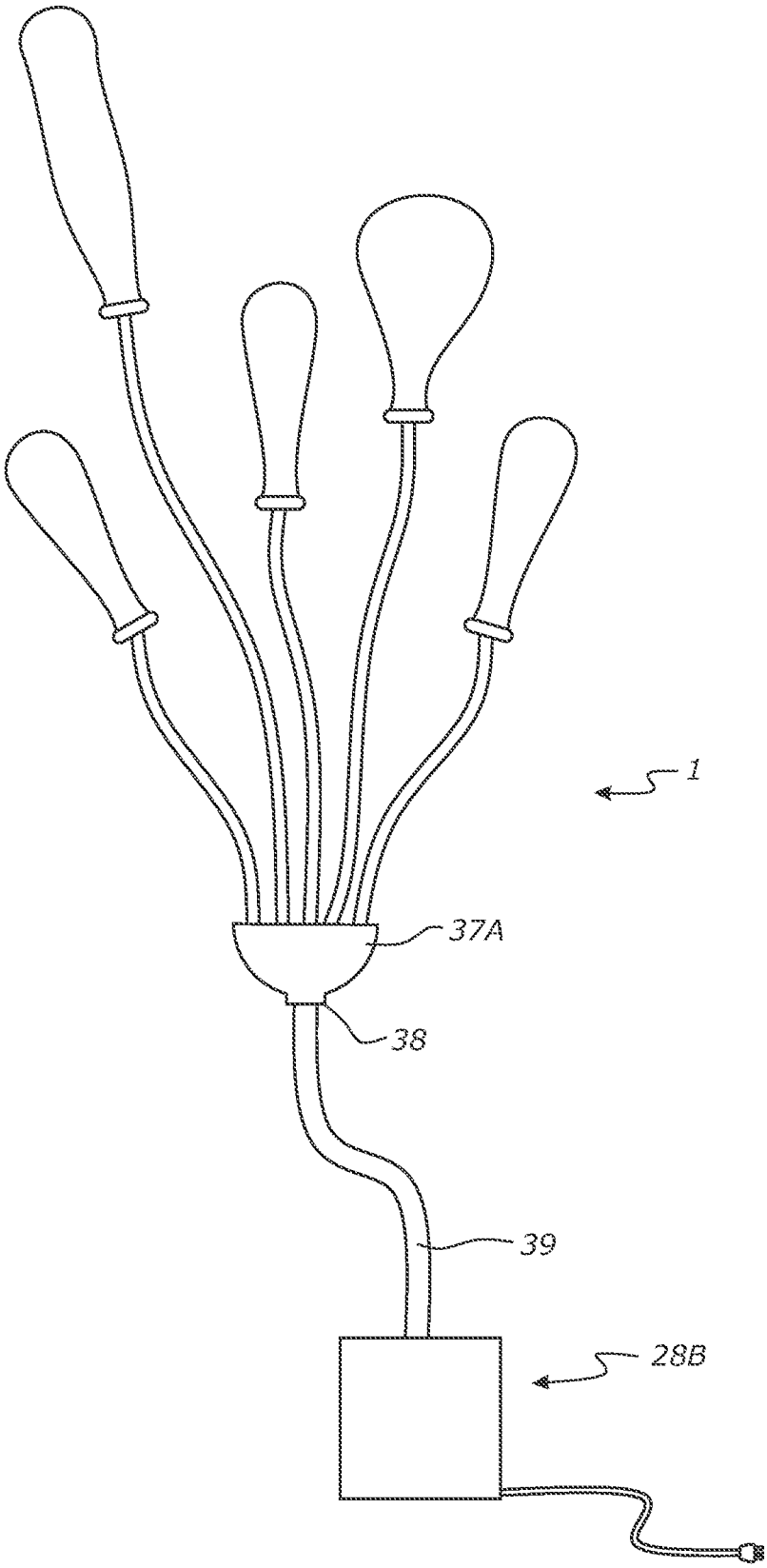
FIG. 1*a* is a view of the plurality of balloon and tether assemblies engaged to a manifold housing that is connected to a pump, the balloons shown in a flaccid state.
Figure 1B:
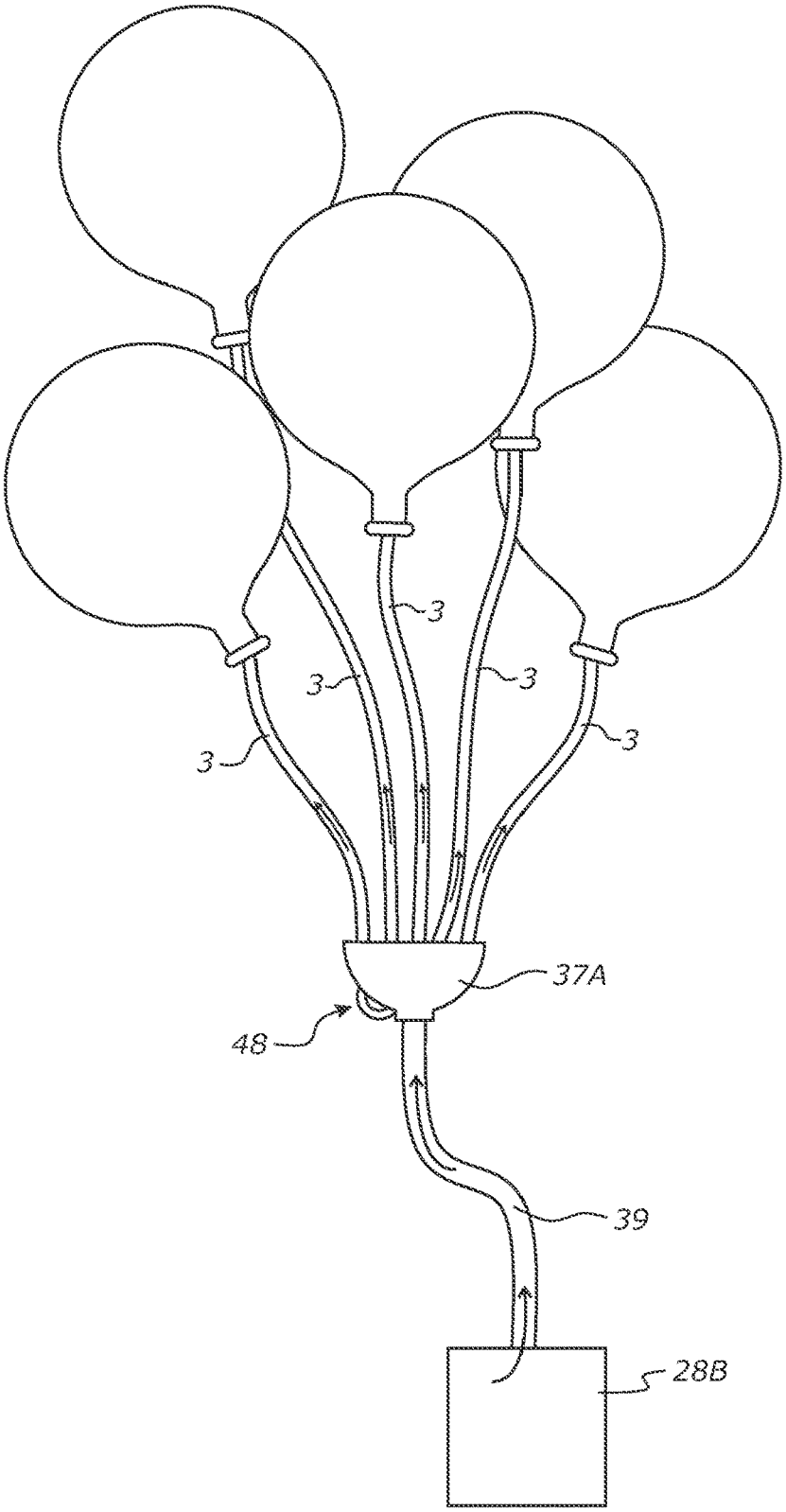
FIG. 1*b* illustrates the balloons of FIG. 1*a* in an inflated condition.
Figure 1C:
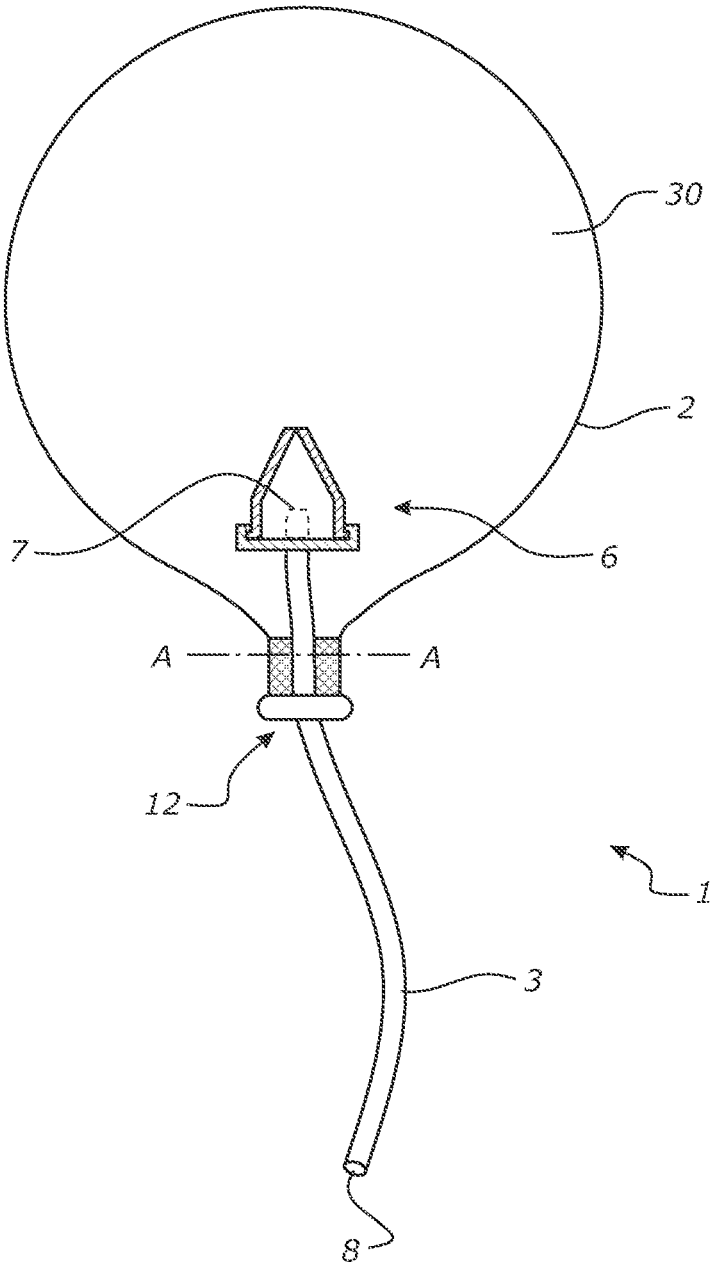
FIG. 1*c* illustrates one balloon and tether assembly including showing the one way valve, wherein the balloon is in an inflated condition.
Figure 1D:
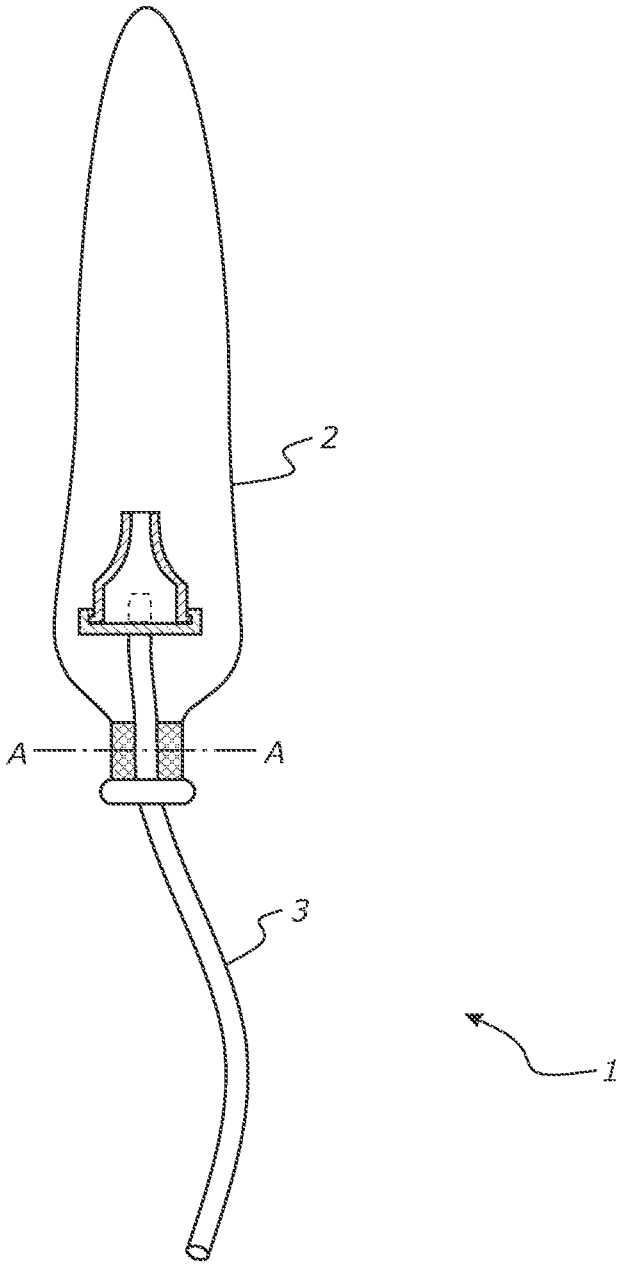
FIG. 1*d* illustrates one balloon and tether assembly of FIG. 1*c* but wherein the balloon is in a flaccid state.

With reference to FIGS. 1*c* and 1*d* a balloon and tether assembly 1 is shown. The balloon and tether assembly includes a balloon 2 and tether 3.

The balloon is able to receive gas such as air via the tether to cause the balloon to be inflated. The balloon in FIG. 1*c* is shown inflated from its flaccid condition shown in FIG. 1*d*. The balloon's flaccid condition may correspond to the gas pressure inside the balloon being the same as ambient air pressure. In some situations, inflation of the balloon may involve increasing the gas pressure from a first pressure that is already above atmospheric pressure to a higher pressure.

The balloon is preferably of an elastic flexible material so that it can increase in volumetric displacement and increase in internal gas pressure when being inflated. It may be made from latex material.

Alternatively the balloon may be of an in-elastic material or a less elastic material compared to latex, yet be flexible and be increased in volumetric displacement as it is inflated by gas. Such a balloon may be made of a foil material.

The balloon has a primary expandable body region 30 and an opening defined at a spout 12 of the balloon. Preferably the spout defines the only opening to the balloon. Where the balloon is made from an elastic material such as latex, the spout may be of a less elastic construction compared to the expandable body region of the balloon. The spout may for example be of a thicker wall thickness compared to the expandable body.

The balloon can expand in size when a gas is delivered inside it. The gas pressure inside the balloon will increase where the balloon is of an elastic material. A balloon will typically inflate from its flaccid condition, growing in volume as gas is delivered into it. The balloon is preferably a party balloon. Such balloons inflate substantially from a small displaced volume when flaccid to a larger displaced volume when inflated. The balloon may be inflated to assume a volume that is at or towards its maximum. When fully inflated an elastic type of balloon is on the verge of bursting due to the gas pressure causing the limit of the breaking strength of the balloon to be reached. Where reference herein is made to inflate or inflation it is not necessarily referring to the balloon being fully filled with gas. It may be partially filled with gas yet be inflated and not be at its maximum volume.

The tether 3 preferably extends to, into and preferably through the spout 12 of the balloon 2 into the balloon and also acts as an inflation conduit for the balloon. The tether is preferably in the form of a tube having an internal flow passage 51 such that the conduit may pass gas from a gas delivery source (e.g. a pump) remote of the balloon and into the balloon 2 to cause the balloon to be inflated.

The tether is preferably of a different material to the balloon. The tether is preferably flexible. It is preferably sufficiently flexible to allow the tether to be coiled and/or be tied into a knot without it breaking. The tether is preferably of a constant cross section and of no more than 4 mm across. For example it may be tubular and of a cross sectional diameter of no more than 4 mm, or in some embodiments of no more than 2 mm or no more than 1 mm in diameter. It may not be perfectly round in cross section.

The tether is adapted and configured to preferably not discernibly expand in cross section or length when containing a pressurised gas. This is preferably achieved by appropriate selection of material and cross sectional shape/diameter and wall thickness of the tether. The tether is preferably elongate. In some embodiments it may be of a length no less than 5 cm long, and in some embodiments more than 30 cm or 60 cm or 100 cm long. In some embodiments it is not desirable for the tethers to be too long, as the plurality of tethers may become entangled. Therefore in some embodiments the tethers may be between 30 cm and 120 cm long. In some embodiments a convenient tether length may be between 50 cm and 100 cm long.

The tether is able to be used to anchor the balloon. This may be to a wall or ceiling or other anchor point to isolate movement of the balloon to a particular region. The tether is preferably of a sufficiently soft material to allow a thumb tack to be pushed through it by hand, in order to anchor the balloon. Alternative fasteners may also be used such as staples, to anchor the balloon by its tether.

In one embodiment as shown, the balloon is bonded at the spout including to the tether to thereat seal the balloon. In this manner the only way for gas to rapidly enter and/or leave the balloon is via the tether. Gas may leave the balloon over a longer period of time by leaking through the wall of the balloon due to the wall, in some constructions, being potentially very slightly permeable to the gas contained inside. But this is a slower process than if the gas were to leave via the spout/tether.

Figure 6:
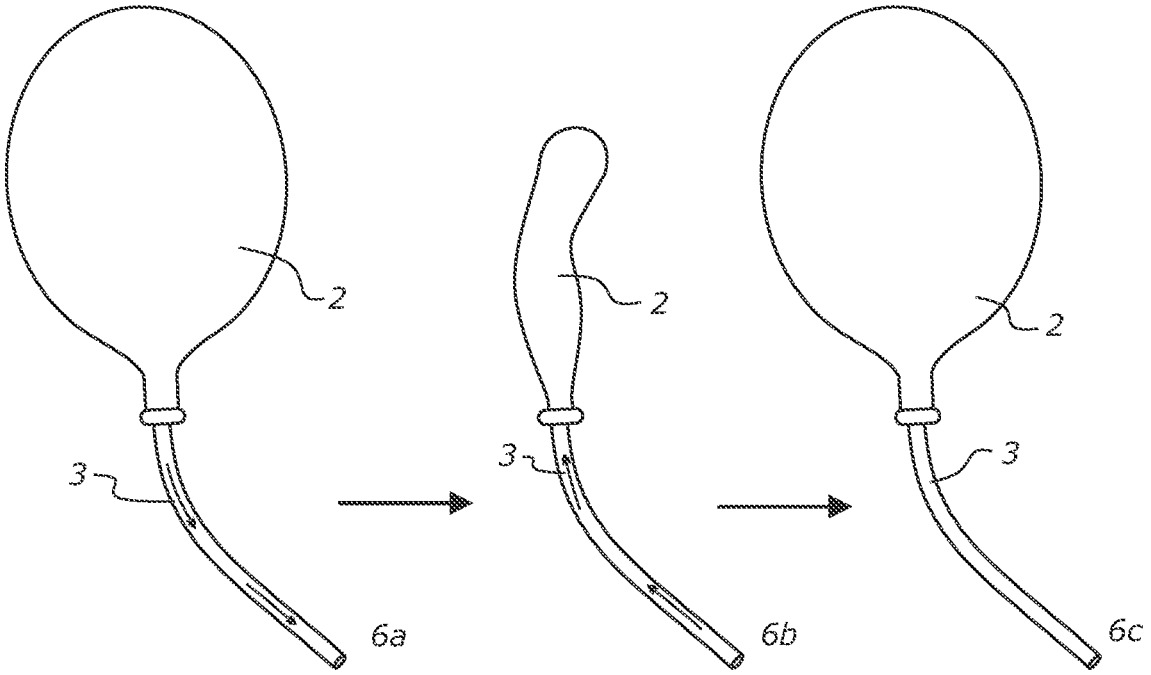
FIG. 6 illustrates the ability for a balloon to be re-inflated using the same tether used for first time inflation and that remains associated with the balloon, wherein in FIG. 6*a* some leakage or release of gas from the balloon is shown to be occurring via the tether.

With reference to FIG. 6 there is described the ability for the balloon to be re-inflated should gas from an inflated balloon leak from the balloon. Therefore a balloon may deflate from for example a condition shown in 6*a* where the balloon is inflated (whether partially or fully) to a less inflated state as shown in 6*b* where the displaced volume of the balloon is less than previous. Gas can again be delivered through the tether 3 to re-inflate the balloon as seen in FIGS. 6*b* and 6*c*.

Figure 2A:
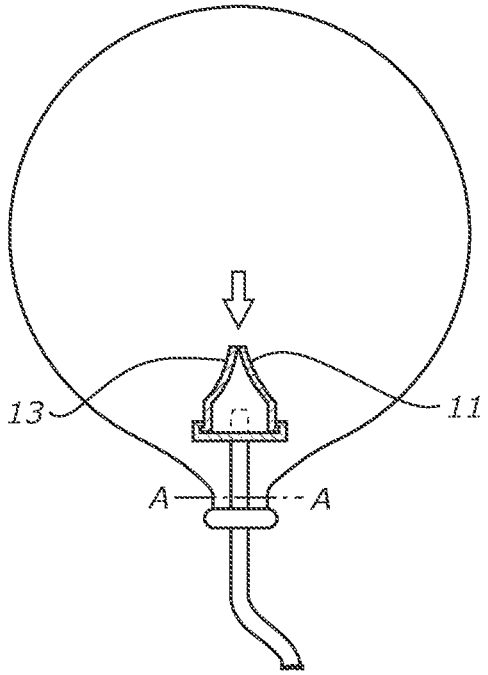
FIG. 2*a* illustrates the balloon and tether assembly and the one way valve in a closed condition.
Figure 2B:
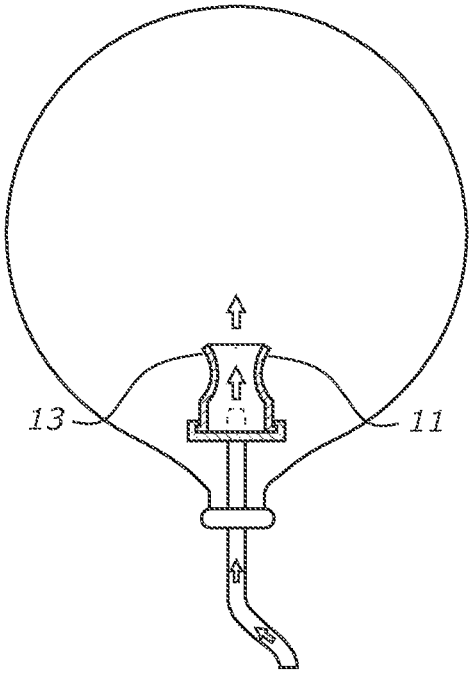
FIG. 2*b* illustrates the balloon and tether assembly and one way valve in an open condition.
Figure 2C:
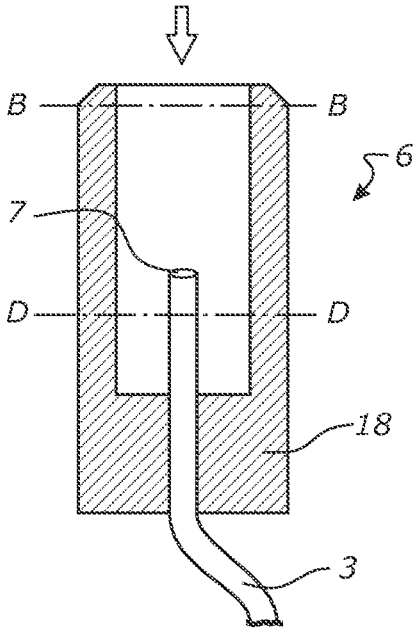
FIG. 2*c* is an illustration of a construction of a preferred form of the one way valve, the valve shown in a closed condition.
Figure 2D:
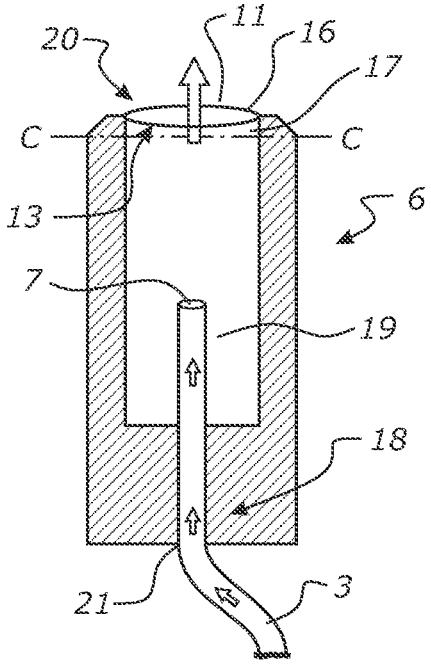
FIG. 2*d* illustrates the one way valve of FIG. 2*c* in an open condition.
Figure 2E:
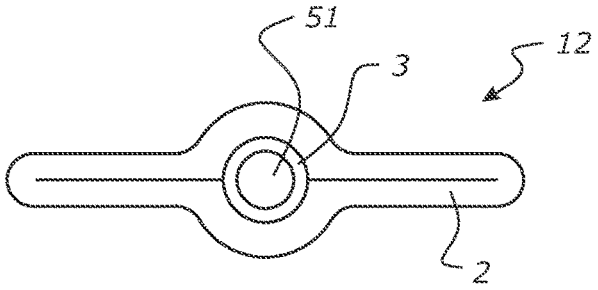
FIG. 2*e* is a sectional view through section AA of FIG. 2*a*.

The bonding at the spout 12 may be by compressing and adhering the spout sealed as shown in the cross sectional view of section AA, seen in FIG. 2*e*. The adhesion may be by welding or by use of an adhesive. The adhesive may form a bead on the inside of the balloon adjacent the bonded region. The bead can help prevent a peeling open of the bonded region as gas pressure in the balloon increases.

An alternative may be that the bond or seal is formed by an O-ring or elastic band which tightly surrounds the spout of the balloon and the tether. The O-ring or elastic band may be provided such that the inflation conduit can remain engaged with the balloon.

In the preferred form the tether is associated with a one way valve 6 which serves to restrict the escape of gas via the tether once the balloon is inflated. In the preferred form this one way valve 6 is provided at the first open end 7 of the tether 3. The tether also has a second open end 8 at where the tether is able to connect directly or indirectly to a gas delivery source. The one way valve 6 preferably resides at the first open end of the tether but may alternatively be placed at other locations along the tether between the first open end 7 and second open end 8. Where the tether extends into the balloon the one way valve is preferably inside of the balloon 2. Alternatively the one way valve may be located at and/or in the spout and at the end of the tether. In this case, the tether may not extend into the balloon other than at least partially into the spout.

Gas passing through the one way valve can enter into the balloon but the one way valve prevents or restricts the flow of gas in the balloon out through the first open end 7 of the spout and out of the balloon.

The one way valve 6 is preferably a duckbill valve. Its operation is more clearly shown in FIGS. 2*a* and 2*b* and 2*c* and 2*d*. The duckbill valve is orientated so as to allow for air to pass through it and is configured to close if the pressure inside the balloon exceeds the pressure inside the valve/tether. Pressure inside the balloon will force the duckbill flaps 11, 13 together thereby sealing the outlet of the duckbill valve.

The valve 6 may be formed from two plies of flexible film material 16 and 17 as seen in FIGS. 2*c* and 2*d*. The film material may be bonded to the tether 3 at a bonded region 18. The two plies are so bonded as to form a passage 19 that extends between the duckbill valve outlet 20 and inlet 21 at where the tether is bonded to the duckbill valve. The first opening 8 terminates between the first end 20 and second end 21 of the passage 19. The plies of the duckbill valve are able to expand and contract away and towards each other at least at the outlet opening 20 as can be seen between FIGS. 2*c* and 2*d*. Facilitated by this flexibility of the plies of material, an opening and closing of the duckbill valve can occur. The walls of the passage 19 of the duckbill valve can expand and collapse. In the expanded condition gas can pass to or from the tether through its first opening 7. In the collapsed condition as shown in FIG. 2*c* the first opening 7 is sealed by the duckbill valve.

Figure 2F:
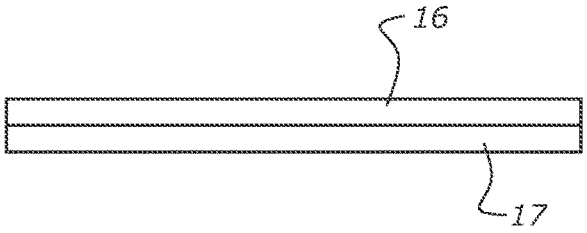
FIG. 2*f* is a sectional view through section BB of FIG. 2*c*.
Figure 2G:
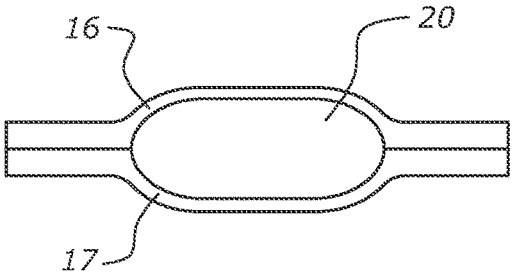
FIG. 2*g* is a sectional through section CC of FIG. 2*d*.
Figure 2H:
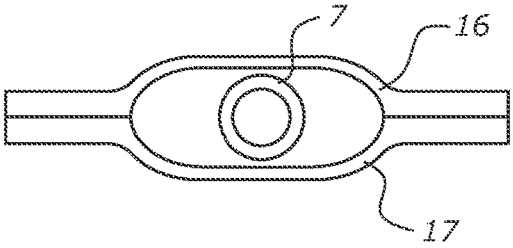
FIG. 2*h* is a sectional view through section DD of FIG. 2*c*.

FIG. 2*f* is a cross sectional view at section BB showing the two plies 16 and 17 pressed against each other to close the duckbill valve. FIG. 2*g* shows the two plies forming an opening of the duckbill valve. In the preferred form the duckbill valve is positioned entirely within the balloon as can be seen in FIGS. 2*a* and 2*b*. Gas pressure inside the balloon is able to effect a sealing of the duckbill valve if the gas pressure inside the tether is less than the gas pressure inside the balloon.

Should any gas leak from the balloon such as through the wall of the balloon and/or through the duckbill valve, it is possible to replenish gas inside the balloon. Such leakage may cause the balloon to at least partially deflate and a replenishing is able to cause the balloon to be re-inflated.

The materials used for the construction of the duckbill are preferably thin and flexible. The duckbill valve itself is preferably relatively small and this helps allow for the balloon to assume a small volume condition when flaccid. This can be important for packing and shipping where it is desirable to reduce the volume of the retail pack in which the balloon or a plurality of balloons (as will hereinafter be described) are retained.

In some embodiments the plies 16 and 17 may be made from a film or sheet material, or materials, with a capacity to develop and hold an electrostatic charge. Examples of suitable materials could include polyurethane, polyester, polypropylene or PVC. The electrostatic charge may assist in attracting the plies toward one another to enhance sealing of the valve, for example when the plies assume their closed condition as shown in FIG. 2*c*. In some examples the plies may develop an electrostatic charge upon separation from one another as air is forced through the conduit 3 and the plies assume their open condition shown in FIG. 2*d*. In some embodiments both of the plies may be made from the same material. In other embodiments the plies may be made of different materials. For example the two different materials may be separated in the triboelectric series. Features of the ply materials, such as surface roughness, may be selected to enhance the development of electrostatic charge.

The embodiment described above, wherein a one way valve 6 is located at or near a first open end 7 of the tether 3, is particularly convenient for construction of the assembly. As an alternative, the one way valve may be sized to fit inside of the internal diameter of the tether, in which case the valve may be positioned either inwardly or outwardly of the spout at another location along the tether between its first and second open ends. In this embodiment the balloon can be attached and sealed directly to the tether, for example with a fastener that extends about a neck of the spout and clamps it to the tube.

However it will be appreciated that in some forms of the invention means other than a one way valve may be provided for sealing the balloon after inflation. For example, the tether may be provided to consumers in a slack knot formation which can be pulled taught to seal off the tether and its associated balloon. This is described in more detail below. Further alternatives may include a crimp or clip applied to the tether to crush the internal passageway of the tether in order to seal it.

The tether 3 is preferably flexible along its entire length. However in parts it may be more rigid including for example at the second outlet 8 where the tether may include a fitting that allows for the second opening to engage with an outlet of a pump or the like.

Figure 3:
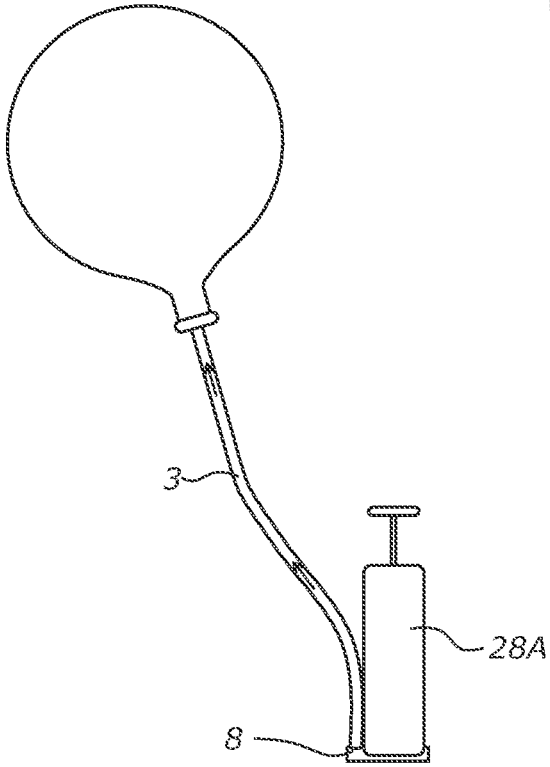
FIG. 3 illustrates a balloon and tether assembly engaged to a hand pump.
Figure 4:
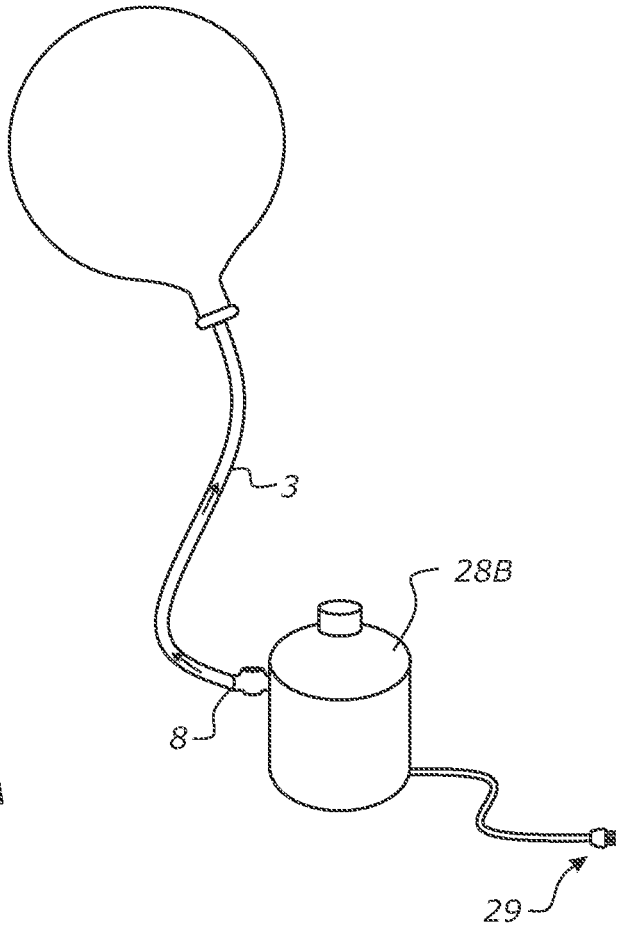
FIG. 4 illustrates a balloon and tether assembly engaged to an electric pump.

As can been seen in FIGS. 3 and 4 a pump 28*a* may come in the form of a hand pump or electric pump 28*b*. The pump 28 may be manually operated by a person to pump air via the tether into the balloon.

The second opening 8 is able to connect with an air outlet of the pump to make a fluid connection with the pump. Preferable this connection between the tether and the pump is a releasable connection. In some forms an intermediate conduit may exist between the pump and where the second outlet attaches for fluid connection. In FIG. 4*a* an electric pump 28*b* is shown. The electric pump may be powered by mains power and may have a mains power plug 29. Alternatively the pump is an electric pump that may be battery powered. It is envisaged that other gas delivery sources gas may be used for inflating of the balloon. Such may include a hand pump or pressurised gas bottle. Or a vacuum cleaner being operated in reverse.

Figure 7:
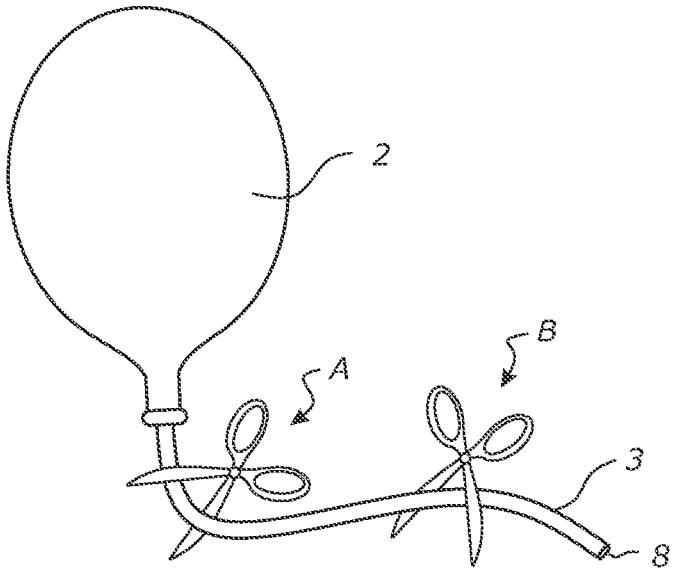
FIG. 7 illustrates the ability for the tether to be severed by for example the use of a tool such as scissors.

Once the balloon has been inflated as seen in FIG. 7 the tether 3 is able to be removed from the gas pressure source. Such disconnection may occur by cutting the tether between its first open end 8 and the balloon 2. Such cutting can be done by a person at a location to ensure that a desirably long tether remains attached to the balloon. Should a person only require a short tether then the scissors can cut the tether at location A, a location closer to the balloon than location B as seen in FIG. 7.

The tether 3 is of material that is conveniently cut by a person. It may also be possible to tear or snap the tether by hand without the use of a tool such as scissors. The tether may come pre-attached to a gas delivery source at its second open end 8. Such connection may be permanent or releasable. If permanent then a removal such as by cutting or snapping of the tether 3 will be required but if the connection between the tether and the gas pressure source is releasable then a removal of the tether by pulling it away from the gas delivery source will be possible. Thereafter a person can still cut, snap or tear the tether to a desired length.

As seen in FIGS. 8 and 9, the balloon is able to be anchored using the tether. Such anchoring may be by way of using a fastener such as a pin or thumb tack 30 or staple or other fastening means that can penetrate through or about the tether and into an adjacent anchor member such as a wall or ceiling or the like. The tether is also able to be tied in a knot and to a structure such as a rail 31 or other anchor member.

Figure 10:
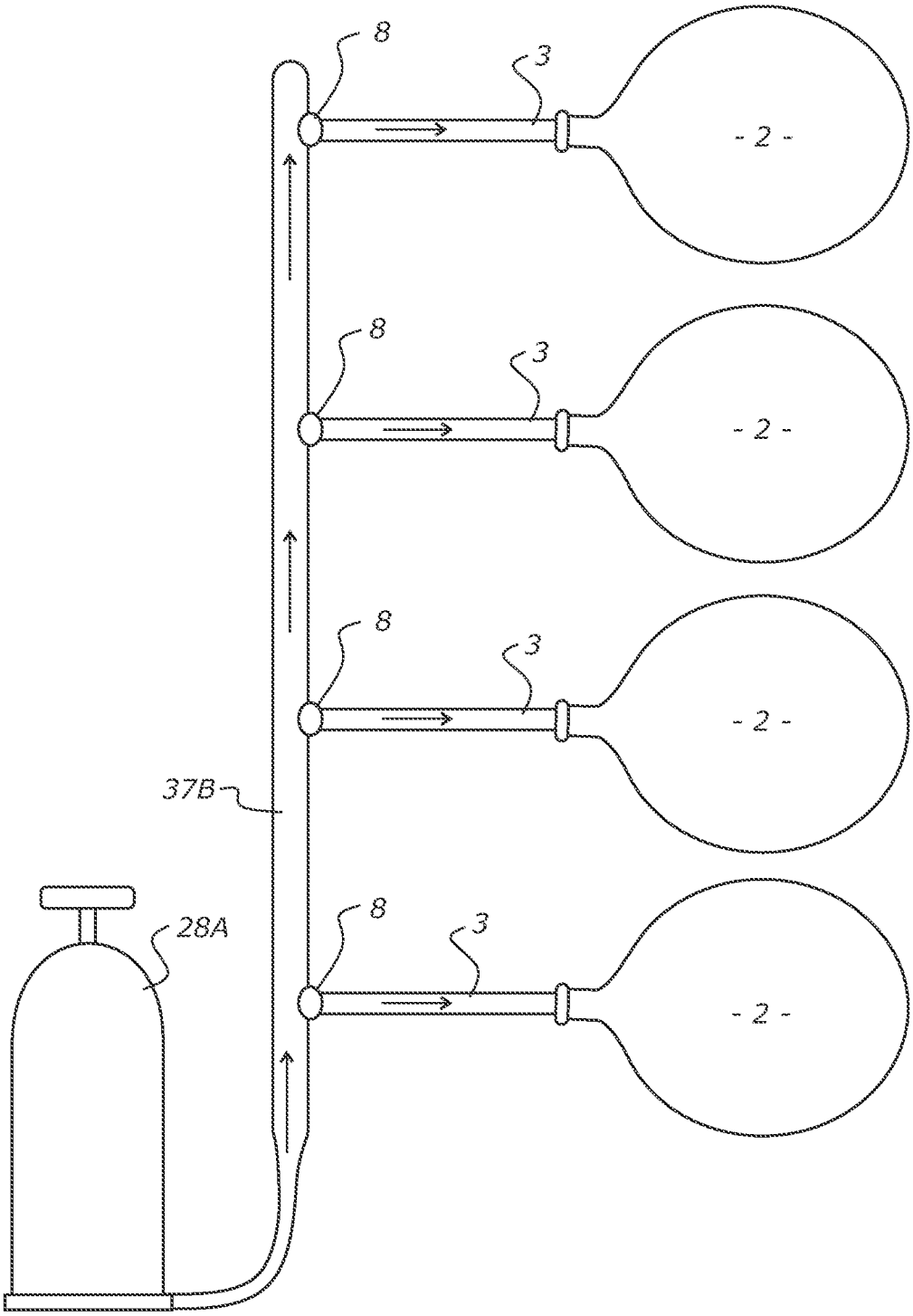
Figure 11:
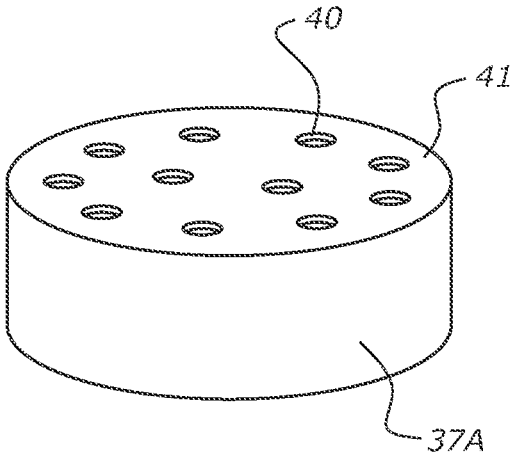
FIG. 11 is a perspective view of a manifold housing illustrating a plurality of gas outlets that can be associated with a respective tether of a set of balloon and tether assemblies.
Figure 12:
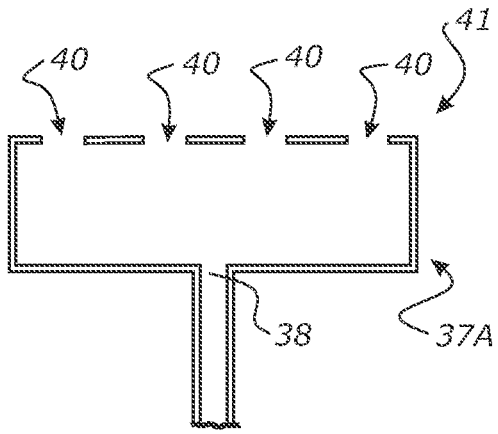
FIG. 12 is a sectional view through the housing of FIG. 11.

In a preferred form a plurality of balloon and tether assemblies are provided as a set. They are provided in a manner so that the balloons are able to simultaneously inflate from a single gas delivery source. The plurality of balloon and tether assemblies 1 are engaged to a manifold 37. An example of this is shown in FIG. 1*a* wherein the manifold is a manifold housing 37A. An alternative manifold is a manifold conduit 37B as shown in FIG. 10 that will hereinafter be described. The manifold housing 37A has a gas inlet 38 at where gas from a gas delivery source such as an electric pump 28*b* can enter the manifold housing 37A. The manifold housing 37A may be connected directly to the pump housing or via an intermediate conduit 39 connected or to be connected to the pump housing. Gas can be delivered from the pump to the manifold housing 37A. The manifold housing 37A is hollow as can be seen for example in FIG. 12 and provides a plurality of gas outlets 40. The tethers at their second open ends 8 are each connected or able to connect to the manifold housing 37A at a respective gas outlet 40. This connection may be permanent or releasable. The gas outlets 40 of the manifold housing 37A may be defined by nipples over or about which the tethers at their second open end 8 are able to be secured in a gas tight or substantially gas type manner. A pulling of the tether relative the manifold housing 37A can allow for the tether to separate from the nipple.

In the preferred form all of the gas outlets 40 are provided at a common region 41 of the manifold housing 37A. Preferably this common region is a face of the manifold housing. Preferably the face at the common region 41 is opposite the manifold housing 37A to where the gas inlet 38 is provided.

Figure 13:
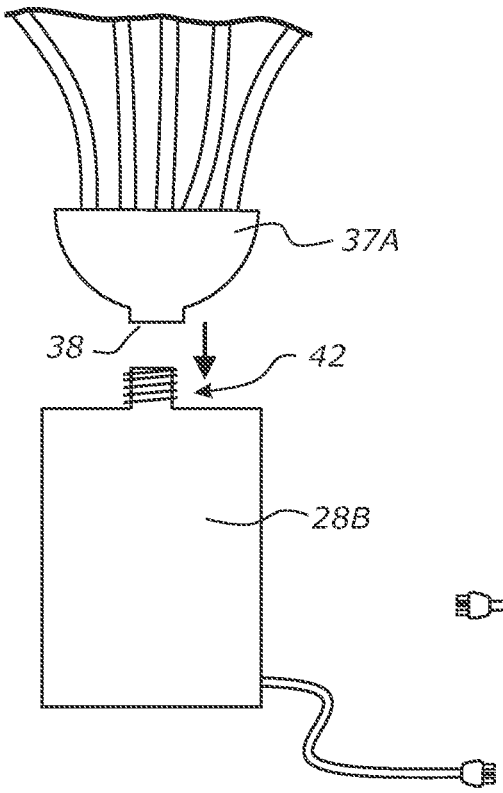
FIG. 13 illustrates a view of a manifold housing about to be secured to an outlet of an electric pump.
Figure 14:
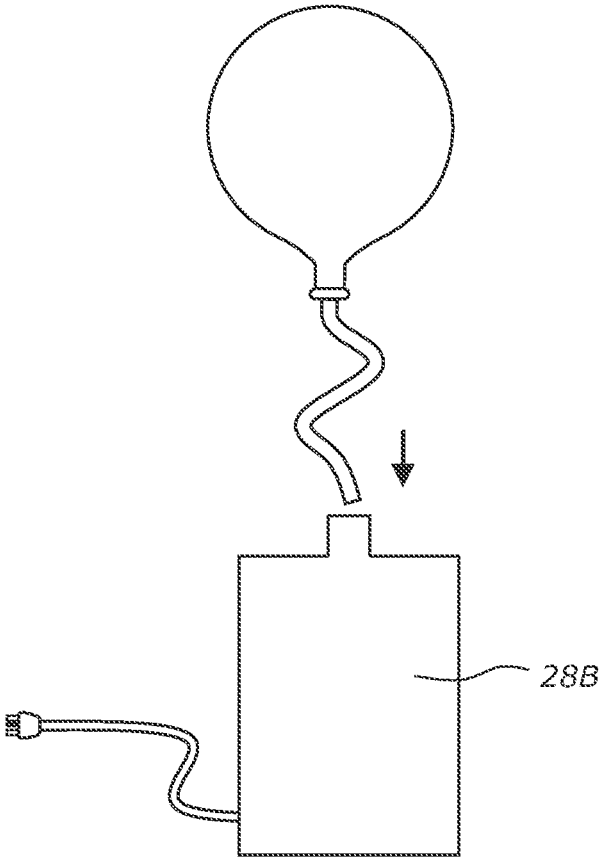
FIG. 14 illustrates the ability for the electric pump, such as one that may have been used for filling a set of balloon and tether assemblies via a manifold as shown in FIG. 13, to also be used for filling and/or refilling individual balloons via its associated tether.

The manifold housing may be connected directly to the pump housing as seen in FIG. 13. A thread 42 of the pump housing and a thread at the gas inlet 38 of the manifold housing 37A may allow for a secure yet releasable connection with the pump to be achieved by the manifold housing. In an alternative form the manifold housing 37A may be permanently secured or be part of the pump housing.

In the preferred form all of the tethers are engaged with the manifold housing 37A and preferably extend in the same general direction from the manifold housing 37A. For example, the tethers may extend alongside one another so as to present the plurality of balloons proximate each other in a bunch. This has the advantage of being able to pack the plurality of balloon and tether assemblies pre-engaged and with the manifold housing in the retail pack 45 to assume a compact condition and a condition ready for rapid inflation of the balloons once the pack is opened.

The plurality of tethers engaged to the manifold housing may each be of the same length or of varying lengths.

The manifold housing 37 may be of rigid plastic material. It is preferably more rigid than the material used for the tethers.

The pump or other gas delivery source 28*a/b* is able to deliver gas through the manifold housing 37A simultaneously into each of the tethers 3 that are engaged to the manifold housing 37A and thereby cause all of the balloons connected by a respective tether to the manifold housing 37A to be inflated simultaneously. Once the pump is turned off or disconnected or the supply of gas is otherwise terminated or where the gas pressure inside the balloons equalises or becomes larger than the gas inside the tethers, each of the balloons will be then self-sealed by virtue of the one way valve.

Once sufficiently or desirably inflated, inflation can stop and the balloons are then able to be used for display for example. The balloons may remain attached by their tethers to the manifold housing 37A. The manifold housing 37A may include a fastening feature 48 that allows for the manifold housing 37A to be anchored to a structure to present the balloons and have them anchored in place. The fastening feature 48 may be a loop or hook or other opening through which a pin or thumb tack or a string can pass to facilitate anchoring. Any intermediate conduit 39 may also remain attached to the manifold housing 37A and it may be provided as a tether for anchoring the balloons. Alternatively one or more of the tethers may be removed from the manifold housing 37A and/or cut to separate the balloons from the manifold housing 37A and allow for each balloon to be individually anchored by its respective tether.

It will be appreciated that one of the benefits provided by the present invention where a plurality of tethers are engaged to the manifold housing 37A is that a simultaneous inflation of all of the balloons can occur. Yet with sealing of the balloons happening for each individual balloon. This means that the balloons can be individually removed or separated from the manifold without causing any of the balloons to deflate. Therefore once a plurality of balloons have been inflated a person is then able to separate each tether from the manifold individually when desired.

Balloons, in particular party balloons, are not all of a consistent construction. Some balloons may be less elastic than others. If during filling it is noticed by a user that a balloon or a few balloons in the set are inflating more rapidly than others and may reach a point of maximum inflation and thereby burst, a person is able to squeeze or seal a tether to prevent supply of gas to that particular balloon or balloons. Once the gas supply is stopped the person can release the tether. This can help control the degree of inflation that or more the balloons in the set is able to achieve.

Remaining attached to the manifold housing 37A, each of the balloons via its respective tether is able to receive additional inflation or be re-inflated if gas does leak from the balloons over time. It is feasible that the set of balloons may remain attached to the manifold housing 37A, be used for a certain period and thereafter be stored. With most latex balloons the air will escape the balloons over a period of 1 to 15 days where the balloons return to or towards a flaccid state. The next time that the set of balloons is wanting to be used, the manifold 37A can be re-connected to a gas delivery source and the balloons can again be re-inflated for use at another event.

Figure 15:
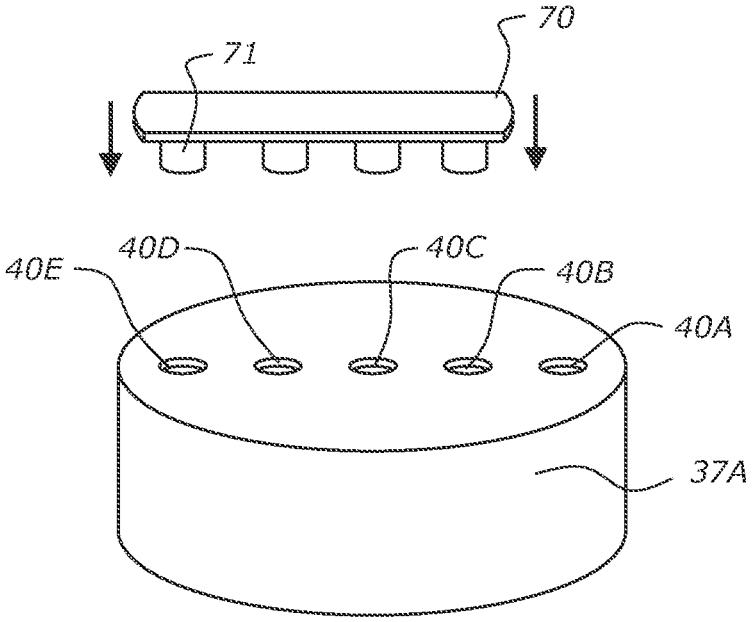
FIG. 15 illustrates a plug that may be utilised with a manifold housing for sealing of a selective number of gas outlets to the manifold.
Figure 16:
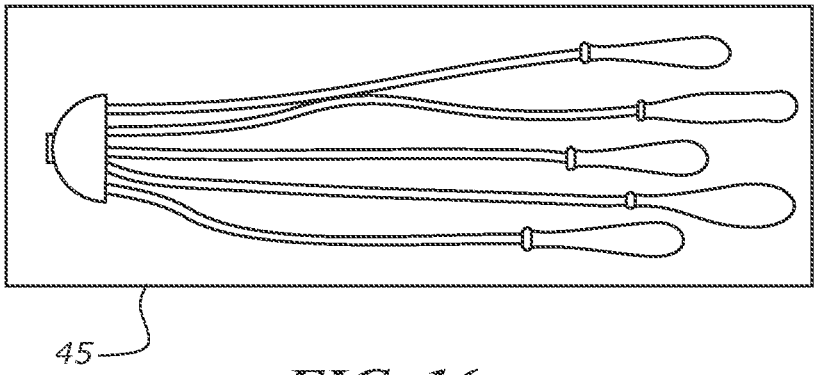
FIG. 16 illustrates a retail pack that includes a plurality of balloons and tethers provided as a set connected in this example to a single manifold housing.
Figure 17:
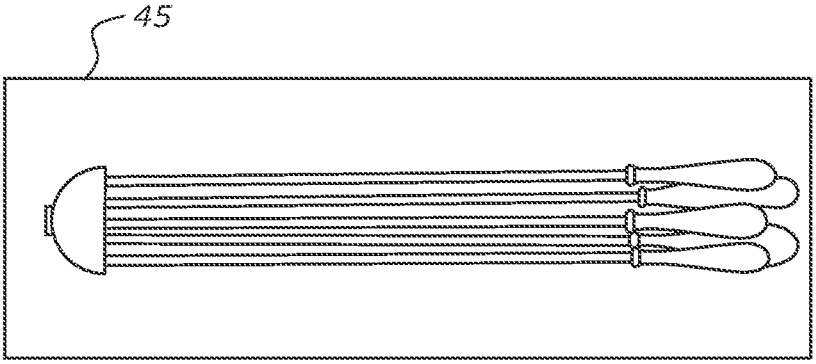
FIG. 17 illustrates the set of balloon and tether assemblies inside the retail pack wherein the tethers are provided in a ribbon formation.

With reference to FIG. 15 there is shown a manifold housing 37*a* with a plurality of gas outlets 40*a*-40*e*. There is also shown a plug 70. The plug 70 includes a plurality of seals 71. These seals are able to locate into the gas outlets of the manifold housing 37*a*. The plug 70 can be used if for example some of the tethers have been removed from the manifold housing and it is desired for the remaining tether attached balloons to be inflated or re-inflated. The plug is able to selectively plug the exposed gas outlets so that the manifold housing 37*a* does not leak when the gas supply is activated. In some situations for example the balloons may have all been separated from the manifold housing 37*a* and one balloon may not have been inflated to a desirable volume or has been deflated and requires re-inflation. The plug 70 can seal the outlet openings 40*b*-40*e* leaving outlet 40*a* exposed for an individual tether to thereat be engaged for the inflation of its balloon. By the provision of the outlets 40 at a common face of the manifold housing, a person's fingers or palm heel could be used to selectively seal some of the outlets. Alternatively a secondary gas outlet may be provided at say the side of the housing. This may be plugged when the balloons are first inflated. When an individual balloon needs inflating or re-inflating, the primary outlets may be sealed by a plug or cap and the secondary outlet may be opened for inflating or re-inflating balloons individually.

Figure 5A:
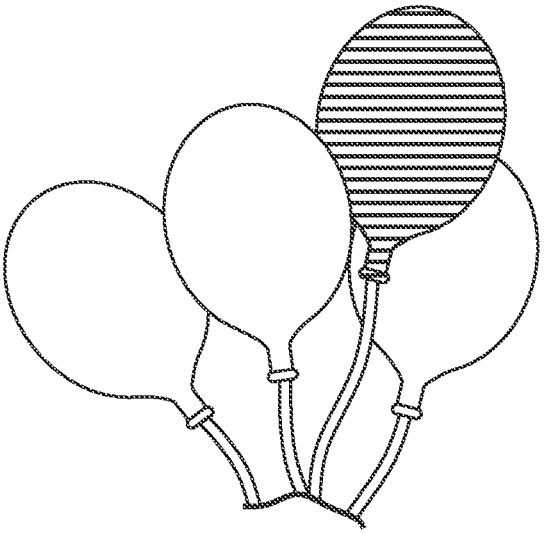
FIG. 5*a* illustrates a set of balloons all of a like or identical construction, such preferably having been provided to a consumer in a single retail pack, wherein the balloons may not all be of the same colour and/or graphics and/or elasticity.

The balloons in a set of tether and balloons assemblies may be of variable configuration. As seen in FIG. 5*a* balloons of different colours may be included in the set. In addition the balloons may be arranged so as to form or be capable of being formed into a particular pattern such as for example seen in FIG. 5*b* where the balloons when inflated may resemble the head of a flower.

Figure 5B:
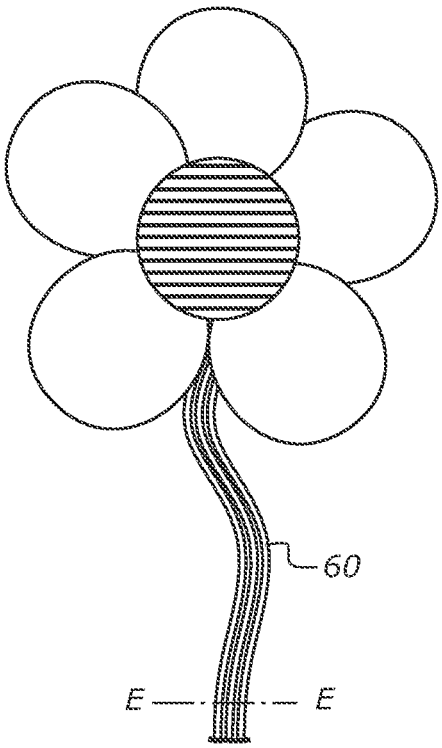
FIG. 5*b* illustrates a variation of the visual nature of the balloons in a set and shows the plurality of tethers in a ribbon formation at least partially connected together.
Figure 5C:
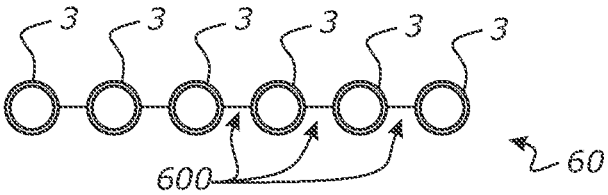
FIG. 5*c* is a sectional view through section EE of FIG. 5*b*.
Figure 5D:
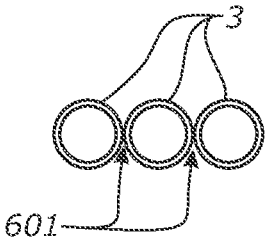
FIG. 5*d* is a sectional view through section EE of FIG. 5*b* but where there are no connector webs used to connect adjacent tethers together.

In the preferred form the tethers of a set are provided to the user attached to each other at least partially along their length. As can be seen in FIGS. 5*b* and 5*c* the plurality of tethers are preferably connected to each other to form a ribbon of tethers 60. The ribbon of tethers keeps the tethers from tangling with each other. This is particularly beneficial when in its retail pack and/or being handled by the end user. The connection between the adjacent tethers as seen in FIG. 5*c* may extend substantially along their entire length. At or near where they reach the balloons and once the balloons start inflating the tethers may start to separate from each other. The connection of the tethers in the ribbon format is preferably a severable connection (for example a connector 600 such as frangible web may be provided between each tether 3 as seen in FIG. 5*c*). The severable connection may also be provided by defining a line of weakness between adjacent tethers. This may be achieved by heat weld or glue joining tethers together at region 601 as seen in FIG. 5*d*, such join being sufficiently weak to let tethers be separated from each other. Alternately the line of weakness may be perforations provided at where the tethers are joined together. This allows for a user to separate tethers from each other as and when desired. The ribbon may have at least 3 tethers joined in this format. Preferably at least 5 and preferably at least 8 tethers and preferably at least 10 tethers are so connected. In the preferred for the retail pack includes at least 3 balloons, preferably at least 5 and preferably at least 8 balloons. Preferably the retail pack contains at least two sets of such numbers of balloons, each set being provided with the tethers in a ribbon format.

A variation of the manifold 37 is shown in FIG. 10. In this variation the manifold is a manifold conduit 37B. It is preferably of a flexible material. It is preferably the same material and preferably the same construction as the tethers. It is able to connect to a gas delivery source such as a pump such as the hand pump 28*a* as seen in FIG. 10. It may be releasably connected to the gas delivery source. Extending at intervals along the manifold conduit 37*b* are the tethers 3 extending to respective balloons 2. Likewise the duckbill valve is located at and preferably in the balloons as herein previously described. In this variation the tethers 3 may be removable from the manifold conduit 37*b* or be cut to separate them therefrom. Alternatively the tethers 3 may be more permanently secured to the manifold conduit 37*b*. Once balloons have been inflated the manifold conduit 37*b* can be disconnected from the gas pressure source and the balloons, as a string in series attached to the manifold conduit, can be anchored by the manifold conduit 37*b*.

Reference will now be made to various components and variations of such components that can be used.

Figure 18:
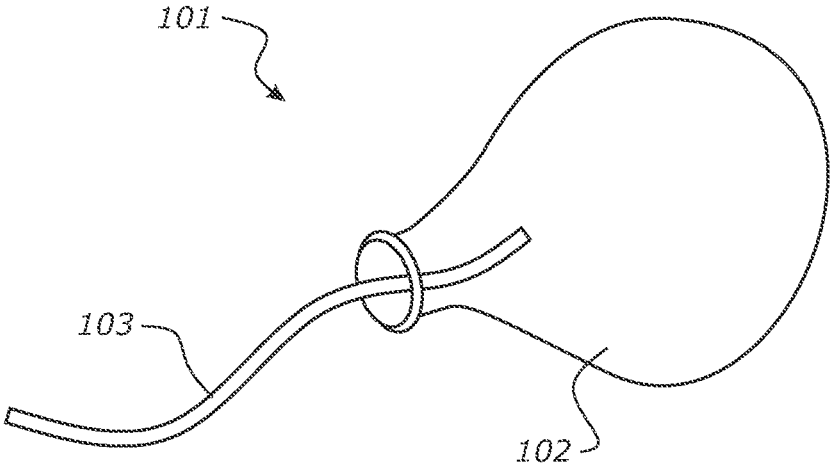
FIG. 18 is a view of a balloon and tether or inflation tube assembly.

With reference to FIG. 18 a balloon and tether assembly 101 is shown. The balloon and tether assembly has a balloon 102 and tether 103.

Figure 19A:
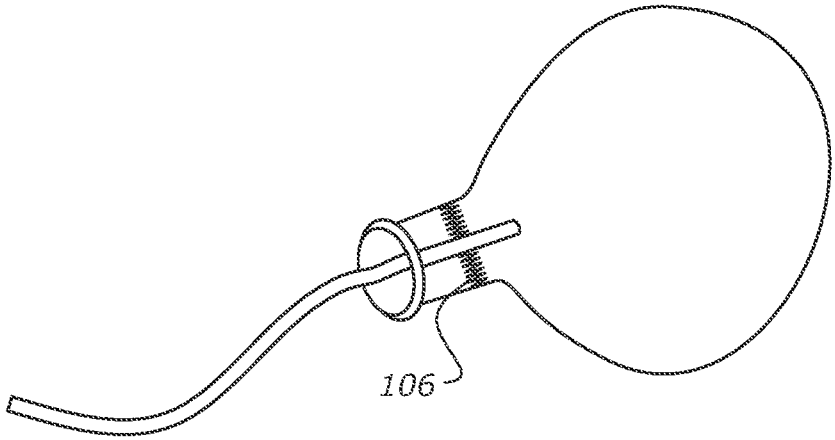
FIG. 19*a* shows an ultrasonic weld seal provided to the balloon to seal between the balloon and the internally extending portion of the inflation tube.
Figure 19B:
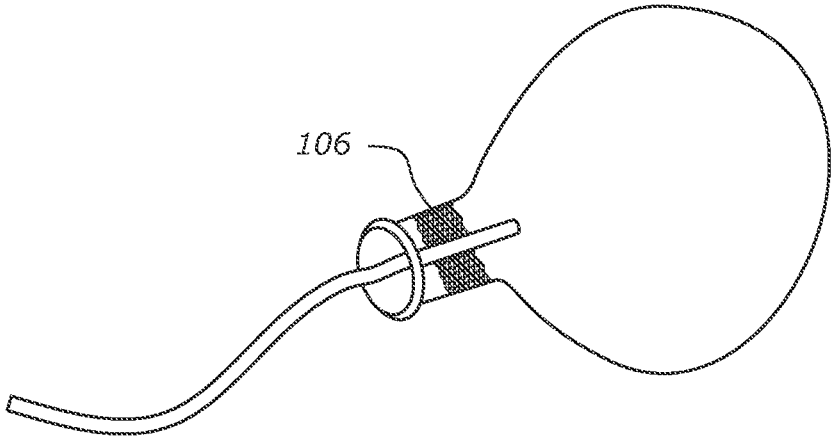
FIG. 19*b* shows a glued seal provided to the balloon to seal between the balloon and the internally extending portion of the inflation tube.
Figure 19C:
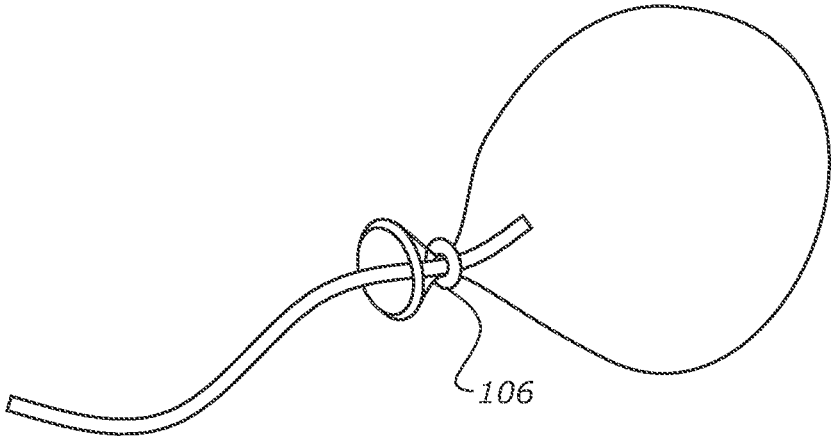
FIG. 19*c* shows an O-ring seal to the balloon around the balloon and the inwardly extending portion of the inflation tube to seal between the balloon and the inflation tube.

In order to prevent the egress of the fluid between the balloon and the tether a seal 107 may be provided across a portion of the balloon and around that inwardly extending portion of the inflation tube or tether 103. The seal 107 may be any suitable means for preventing egress of air at the mouth of the balloon between the balloon and the tether. The seal ensures that the mouth of the balloon can only receive gas and release gas via the tether. FIGS. 19*a*-*c* show different embodiments of the seal 6 provided to balloon and tether assembly 101. For example, as shown in FIG. 19*a* seal may be formed by a weld such as an ultrasonic weld in the material of the balloon such that the sides of the balloon are sealed against one another and a seal is formed around the inflation tube 103. Alternatively, as shown in FIG. 19*b*, the seal may be formed by a gluing of a portion of the balloon such that seal is provided around the inwardly extending portion of the inflation tube. Further alternatively, as shown in FIG. 19*c*, seal 107 may be provided by an O-ring which surrounds a portion of the balloon and the inwardly extending inflation tube. The O-ring may be provided such that the inflation tube remains fixedly engaged with the balloon.

Figure 20A:
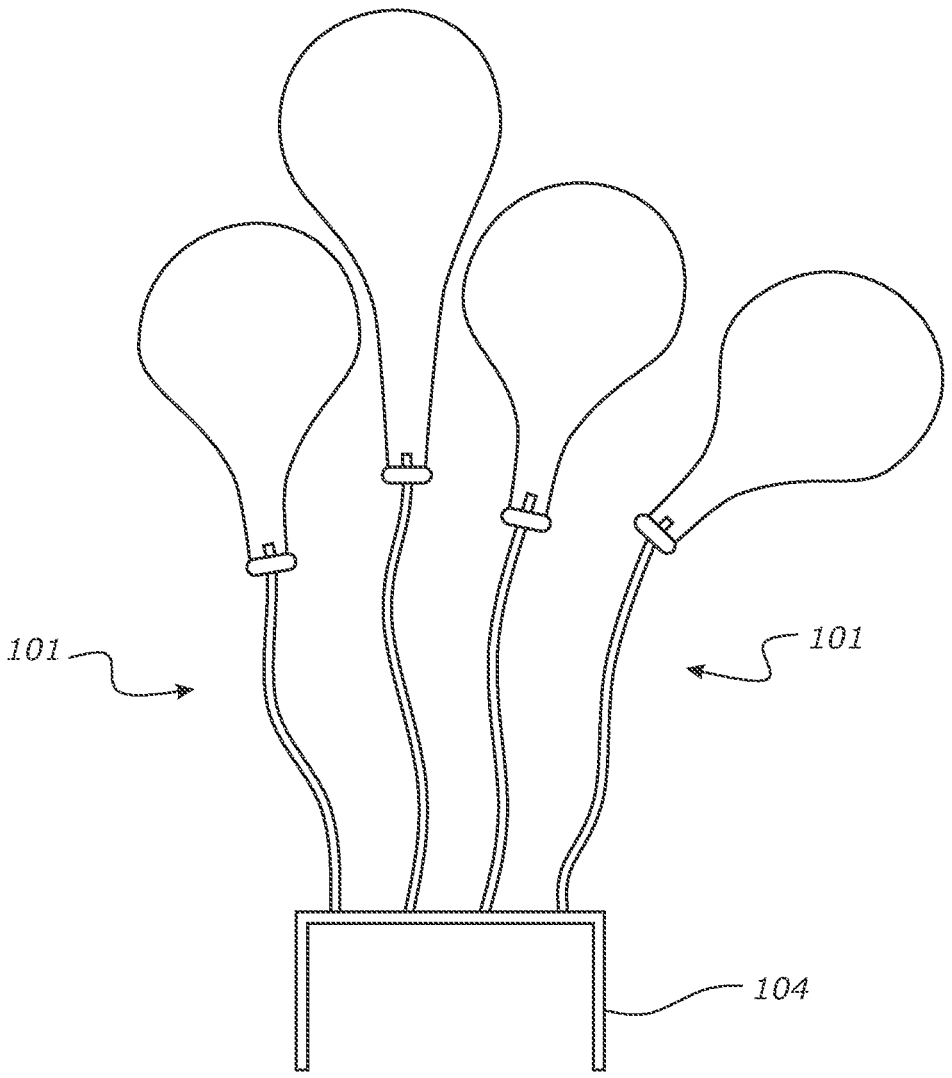
FIG. 20*a* shows an assembly of a plurality of balloons and inflation tubes with a manifold.
Figure 20B:
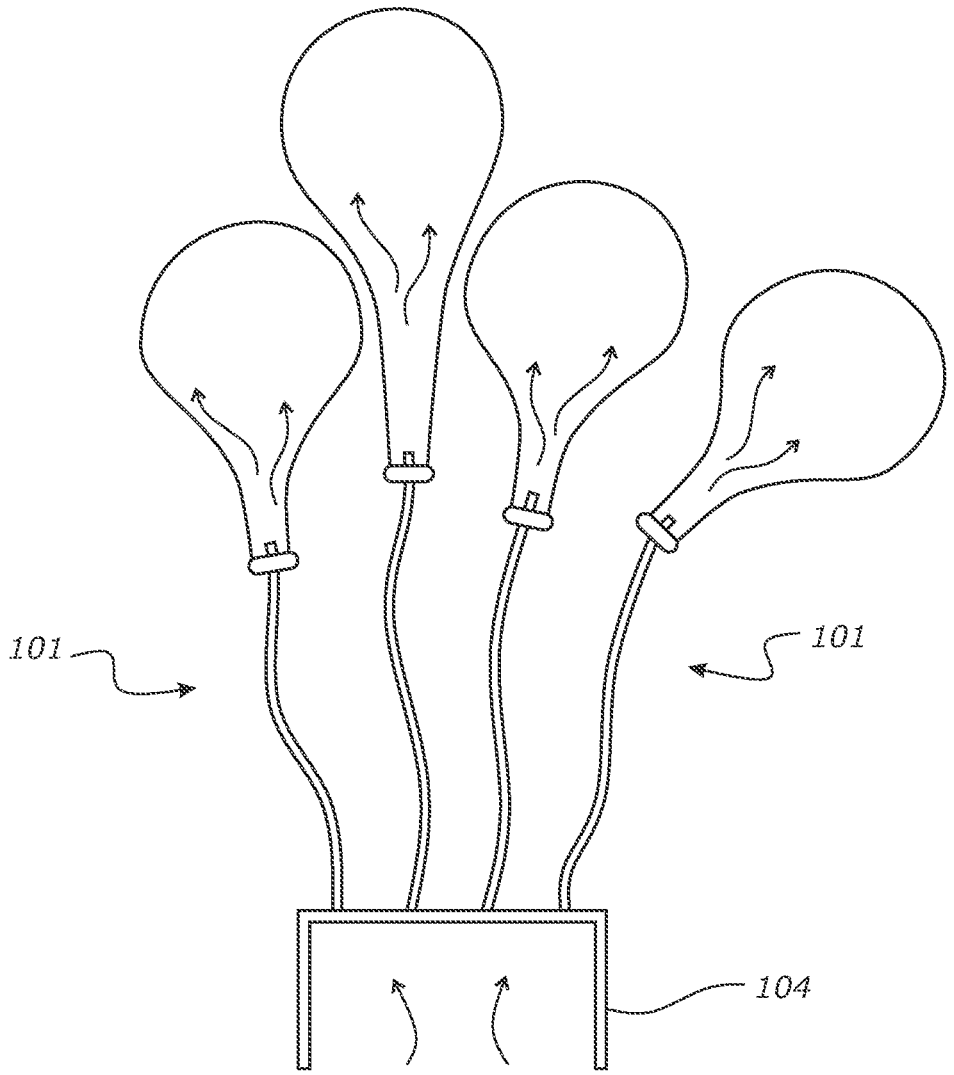
FIG. 20*b* shows the assembly of FIG. 3*a* with the directions of fluid flow through the assembly during the inflation of the balloons.

A plurality of balloon and tether assemblies may be provided such that the plurality of balloons may be inflated at the same time. In order to do this the plurality of balloon and tether assemblies may be coupled with a manifold 104 as shown in FIG. 20*a*. The plurality of inflation tubes are coupled with the manifold 104 such that they are in fluid connection. The manifold may then be connected with a fluid source such that fluid may pass from the manifold, through the plurality of inflation tubes, and into the balloons to inflate them. This is shown in FIG. 20*b*. The manifold may be connected to adapted to be connected to a hose of a domestic vacuum cleaner that can operate in reverse mode in order to drive air out of the hose. This may be a suitable source of air to inflate the balloons.

Figure 21A:
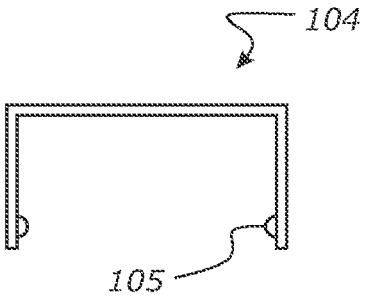
FIG. 21*a-c* show only the manifold of the invention with a variety of different interference-fit and threaded connections between the manifold and the fluid source.
Figure 21B:
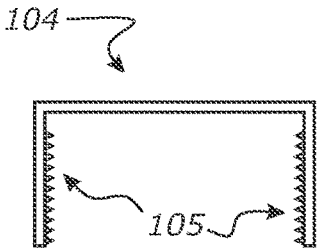
Figure 21C:
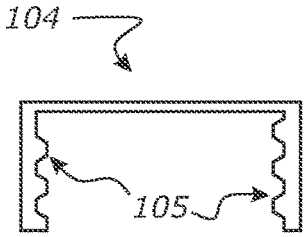

The manifold 104 may have any suitable connection means 105 for coupling with the fluid source such as a snap fit connection, interference fit connection, or threaded connection as shown in FIGS. 21*a-c*.

Figure 22B:
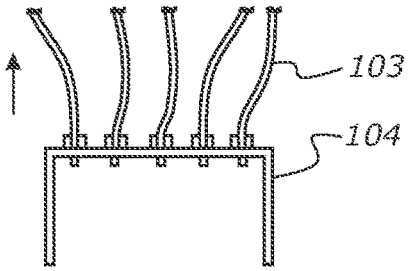
FIG. 22*b-c* show the manifold and inflation tubes where the tubes are removably connected to the manifold.
Figure 22A:
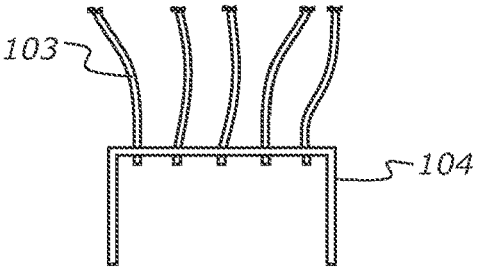
FIG. 22*a* shows the manifold and inflation tubes where the tubes are permanently connected with the manifold.
Figure 22C:
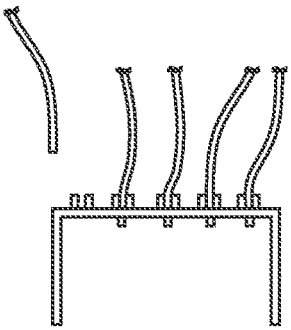

As shown in FIG. 22*a* the inflation tubes 103 preferably engage with the manifold 104 in order to pass fluid to the balloons for inflation. The engagement between the inflation tubes 103 and the manifold 104 may be such that the components are permanently coupled with each other. In an alternative form as shown in FIGS. 22*b-c* the inflation tubes may be releasably connected with the manifold 104. The releasable connection may allow an inflation tube to be removed from the manifold once the balloon has been inflated by the application of a force to separate the inflation tube from the manifold.

Figure 22D:
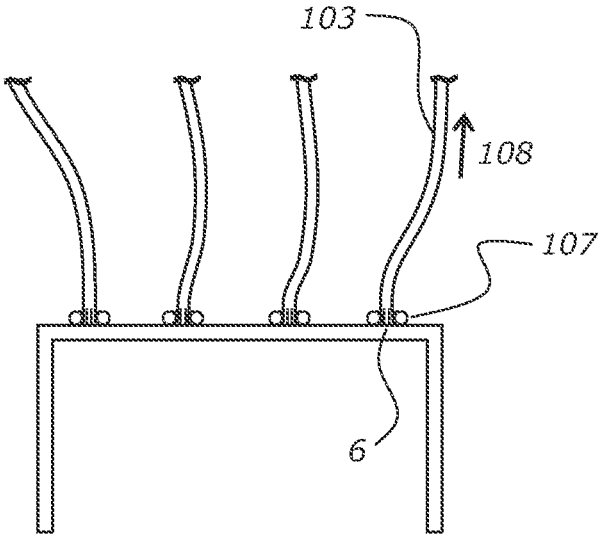
FIG. 22*d-e* show another form of removable connection between the manifold and the inflation tubes where the manifold further comprises manifold outlets which are received by the inflation tubes, and where tube closures are provided to close the removed tubes.
Figure 22E:
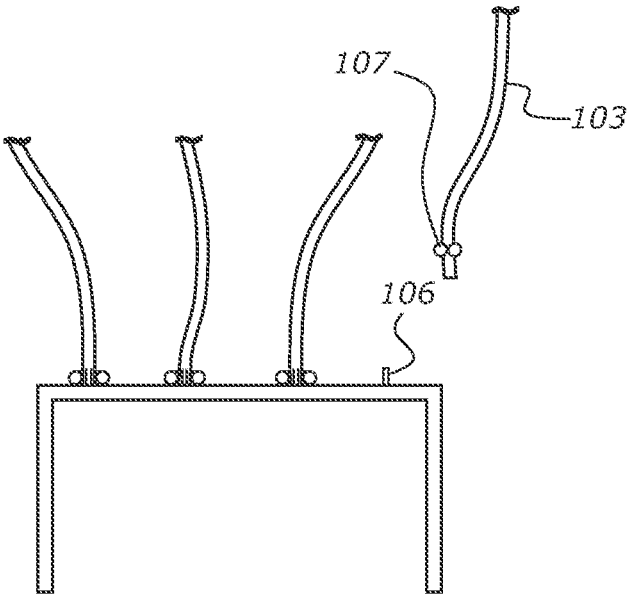

A specific embodiment of this releasable connection is shown in FIG. 22*d-e*. In this embodiment the manifold 105 further comprises manifold outlets 106 such that the inflation tubes 103 are engaged over the manifold outlets. The manifold outlets have an external profile which corresponds to the internal profile of the inflation tubes 103 such that a seal may be formed between the manifold outlets and the respective inflation tubes. Surrounding the inflation tubes 103 and manifold outlet are tube closures 107. When a balloon and tether assembly is sufficiently inflated and is to be released from the releasable connection the inflation tube is pulled in the direction of the arrow 108 in FIG. 22*d*. Upon removing the manifold outlet 106 from the inflation tube 103 the tube closure 107 acts to crimp down on the inflation tube and form a closure to prevent the fluid from escaping. The crimped inflation tube 103, sealed to prevent the fluid from escaping, is shown FIG. 22*e*.

In order to achieve this crimping the tube closure 107 has a biased clamping or constricting force which acts to bend the flexible sides of the inflation tube and close off the internal flow path of the inflation tube. The tube closure 107 may be in the form of an O-ring. In order to prevent the tube closure 107 from crimping the inflation tube 103 and manifold outlet 106 and preventing fluid flow while the inflation tube is still in connection with the manifold the crimping force provided by the tube closure 107 may be sufficient to crimp the inflation tube alone but not such as to crimp the combined inflation tube and manifold outlet where the manifold outlet is inserted into the inflation tube. To this end the manifold outlet 106 may be formed from a comparatively stiffer and less flexible material than that of the inflation tubes.

In one form the inflation tubes 103 may be formed from a flexible material such that the sides of the inflation tube may be deformed under sufficient external pressure and towards each other in order to close off the gas flow path of the inflation tube.

Figure 23A:
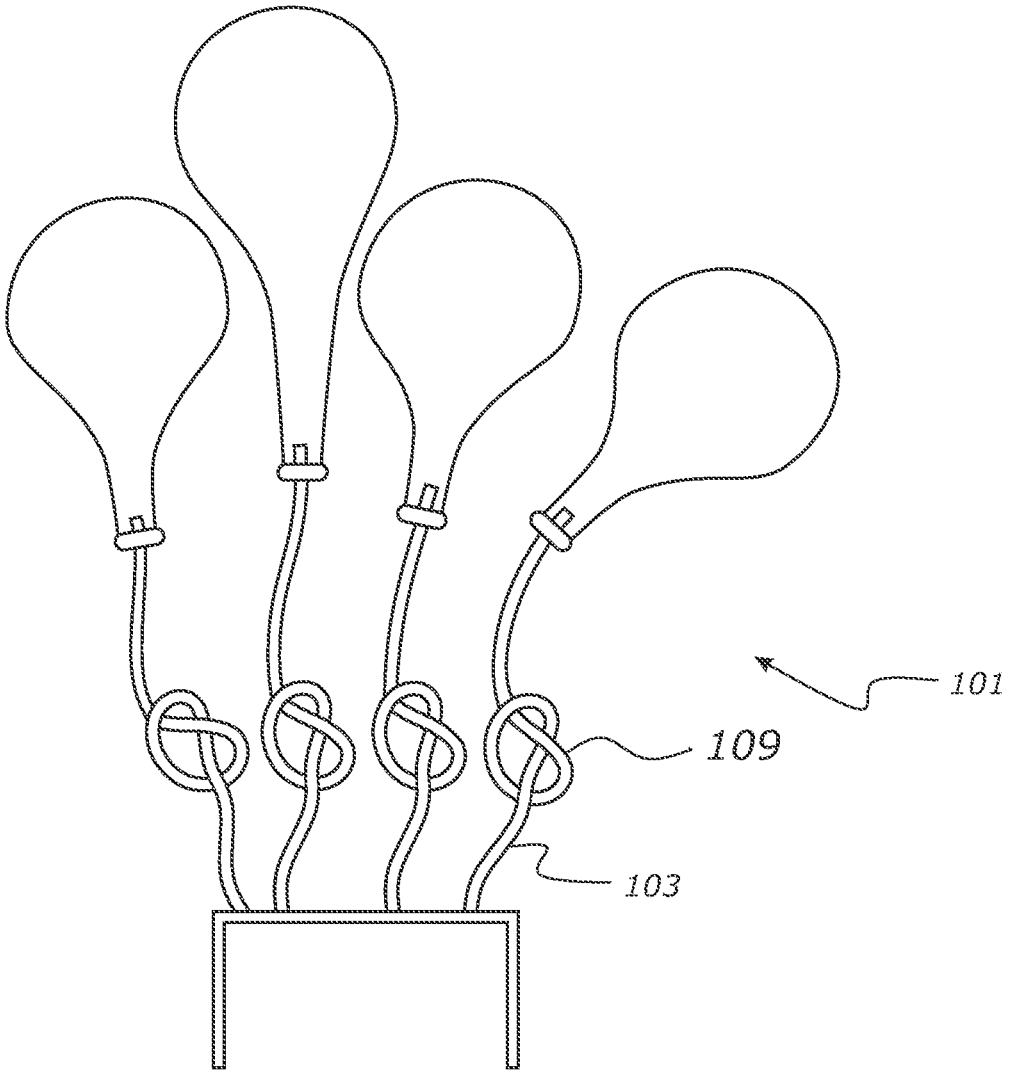
FIG. 23*a* shows the plurality of balloon and tether or inflation tube assemblies with the manifold where the inflation tubes have knots formed in them.
Figure 23B:
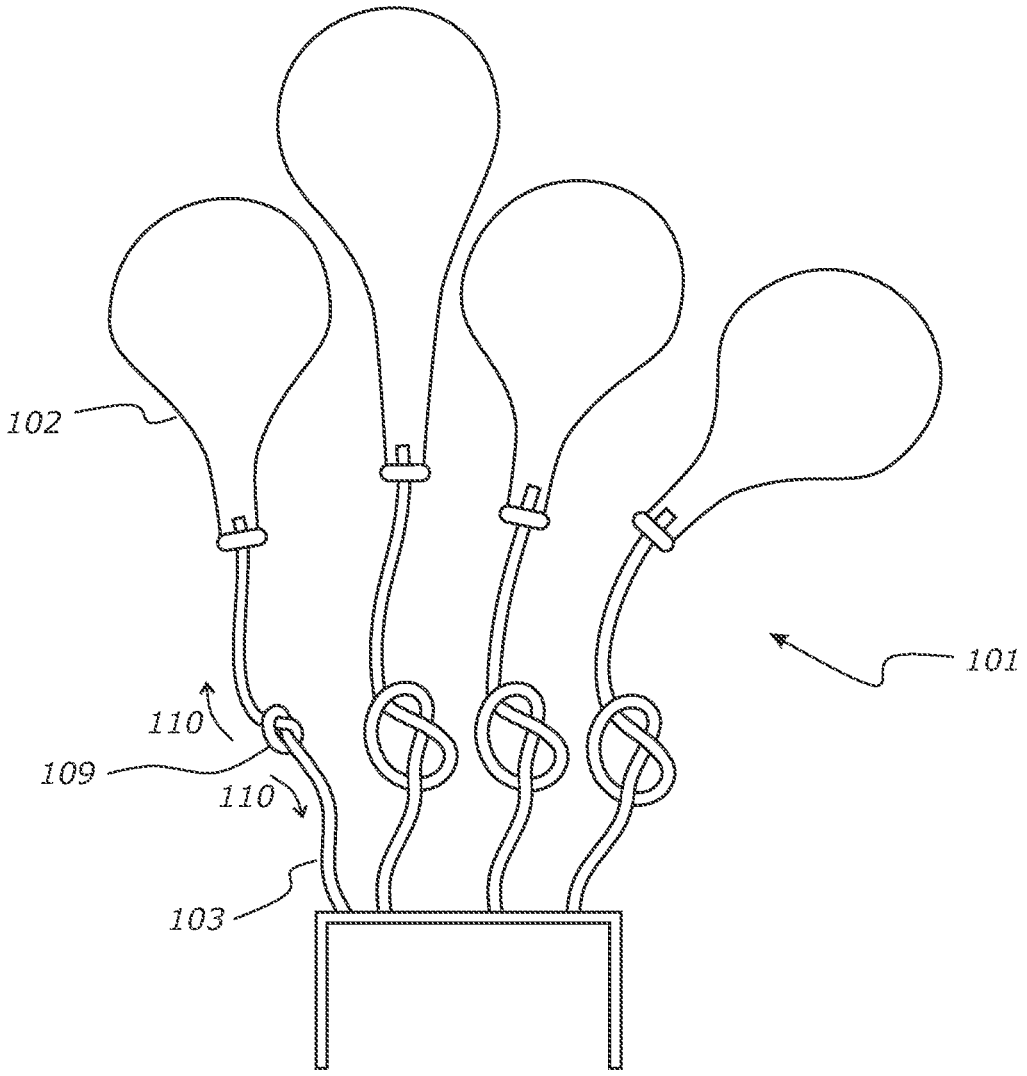
FIG. 23*b* shows the assembly of FIG. 23*a* where one of the inflation tubes has been tensioned to tighten the knot and close the tube.

An alternative closure for sealing an inflation tube once the balloon is sufficiently inflated will now be described. With reference to FIG. 23*a* the inflation tubes 103 of the plurality of balloon and tether assemblies 101 have a slack knot 109 provided in them. This is the manner in which the balloon and tether assembly may be provided is its retail pack. Once the balloons have been inflated to a desired volume the inflation tube may be pulled in the direction of the arrows 110 to tighten the knot 109. As the inflation tubes 103 are preferably comprised of a flexible material a tightened knot will serve to crimp the flow path of the inflation tube and prevent the egress of fluid from the balloon.

Figure 23C:
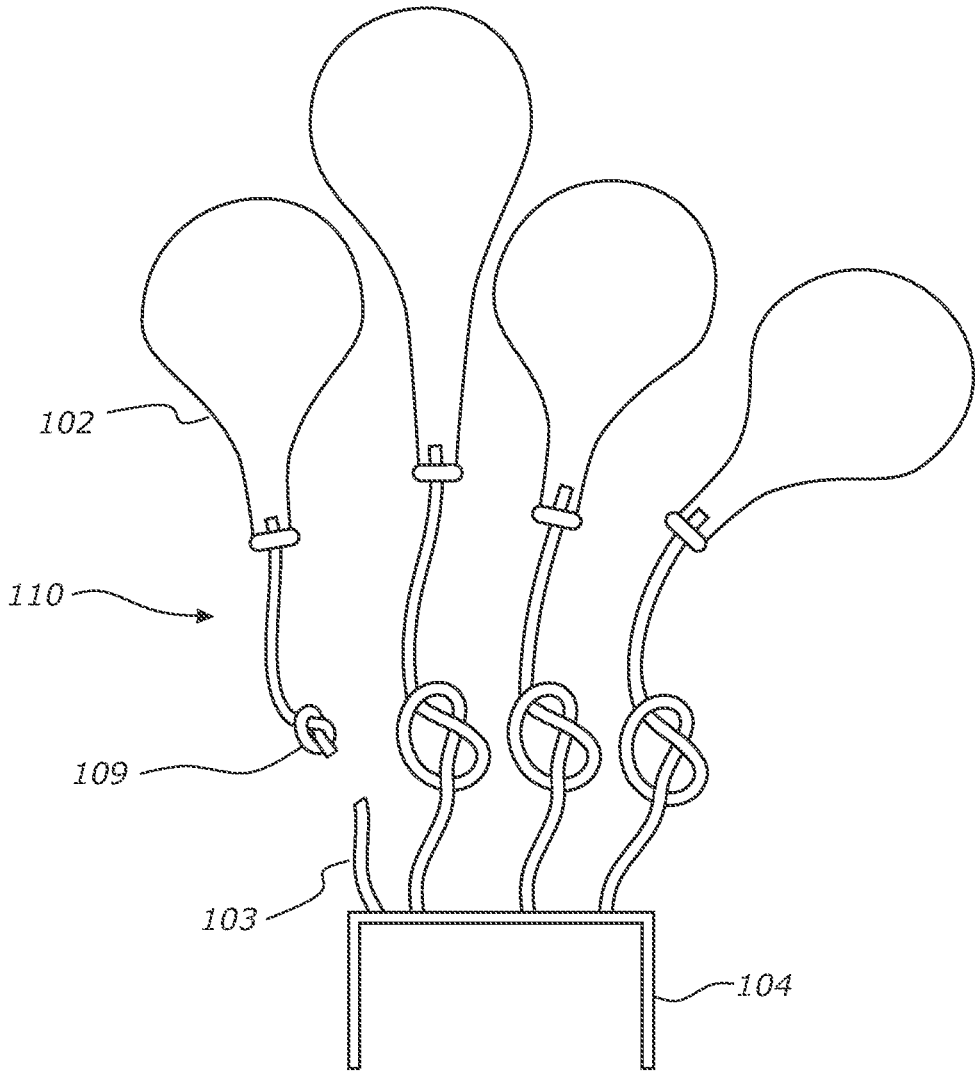
FIG. 23*c* shows the assembly of FIG. 23*b* where the balloon and inflation tube assembly has been severed to leave a separated balloon and tether assembly.

When the knot is sufficiently tightened such as to form a closure and seal the flow path of the inflation tube the inflation tube 103 may be severed at a point between the knot 109 and the end at for example the manifold 104. This is seen in FIG. 23*c*. This may be done by applying enough force to manually tear each tube. Or a knife or scissors may be used.

The remaining portion 110 of the knot sealed tether 103 may remain associated with the balloon and provides a tether for the inflated and sealed balloon. The advantage of the use of a duckbill valve over knot sealing the tether is that for the duckbill valve is self-sealing.

In an alternative form the closure of the inflation tubes may be provided by other manual means post inflation of the balloons such as a user manually tying a knot in the inflation tube to form a closure or a weld closure such as a heat weld or ultrasonic weld to form the walls of the inflation tube into each other.

In a further alternative form the inflation tubes may be such that a crimping force provided to the outside of the inflation tube may permanently deform the tube and form a closure by cutting off the flow path of the inflation tube. This ability to be permanently crimped may be provided by the material of the inflation tube or of a portion of the inflation tube or may be provided by an additional component external to the inflation tubes.

Figure 24A:
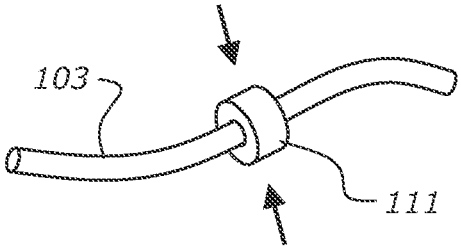
FIGS. 24*a-b* show a section of an inflation tube with a deformable crimp provided around it, both in an un-crimped and a crimped condition.
Figure 24B:
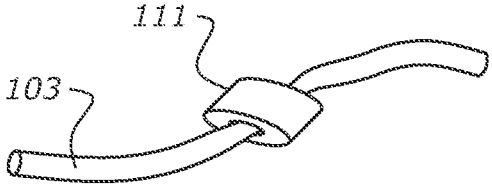

An externally provided component could include a sleeve provided over a portion of the inflation tube which, when crimped by an external force, deforms permanently such that it forms a closure in the inflation tube. Such a configuration is shown in FIG. 24*a-b* where a deformable crimp 111 is located around a portion of the inflation tube. Upon a force being applied in direction of the arrows of FIG. 24*a* the deformable crimp 111 may be formed into the flattened shape shown in FIG. 24*b*. In this configuration the deformable crimp 111 acts on the inflation tube 103, forming a closure in the inflation tube.

Figure 24C:
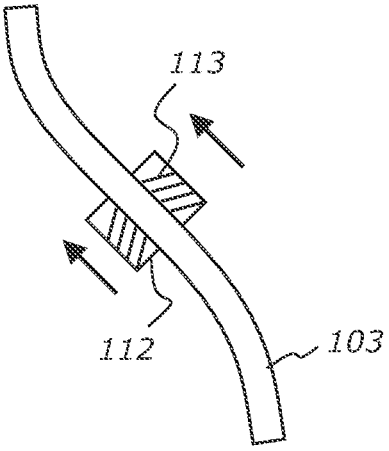
FIGS. 24*c-d* show a cross-section of a portion of an inflation tube with a slidable crimp provided to the inflation tube, both in an un-crimped and a crimped condition.
Figure 24D:
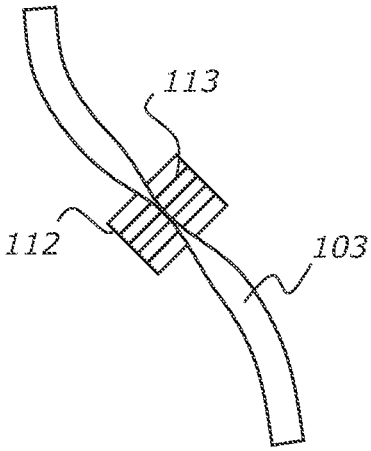

Another externally provided component is shown in FIGS. 24*c-d*. The slidable crimp 112 is provided over a portion of the length of the inflation tube 103. The slidable crimp 112 has an external rigid housing and one or more flexible or deformable tines 113 located inside the housing. The length of the tines is such that it is greater than the distance from the inside of the housing to the outside of the inflation tube, as seen in FIG. 24*c*. Preferably the tines 113 are biased into contact with the surface of the inflation tube. Upon a sliding of the crimp 112 along the inflation tube 103 in the direction shown by the arrows of FIG. 24*c* the tines 113 may be forced into engagement with the surface of the inflation tube 103, crimping it and forming a closure. This is shown in FIG. 24*d*.

In any of the embodiments where a closure is formed in the inflation tube such a closure may be at the end of the inflation tube towards its connection to the manifold 104, or towards the balloon 102, or anywhere along the length of the inflation tube.

In an alternative embodiment where the plurality of inflation tubes 103 are permanently engaged with the manifold 104, once the balloons have been inflated to a desired amount the manifold is sealed such as to prevent the fluid egressing from the plurality of balloon and tether assemblies.

According to the invention a plurality of balloons may be filled with a fluid at the same time through respective inflation tubes. The tether length is such that when fully inflated each balloon may just be in contact with the others as a bunch. Or may still be separate or separatable from the others. A manifold in connection with the inflation tubes may be used to simultaneously provide the fluid for the inflation of the balloons. Once inflated, the inflation tubes may then be closed, and the inflation tubes disassociated from the manifold. The closed inflation tubes may then function as a tether devices to provide tethers for the balloons.

The plurality of inflation tubes 103 in connection to the manifold 104 may be of the same length or may be of a variety of differing lengths. They are preferably at least 50 cm long and preferably at least or about 80 cm long. Once inflated, the inflation tubes may instead remain attached to the manifold. The manifold may keep the tethered balloons as a bunch. The manifold may include a securing region at where the manifold can be secured with or by or to another item. For example the manifold may include a hole or hook to receive a string to allow the still tethered balloons to be suspended by the string from a ceiling or rafter. It may also be able to receive a nail to be nailed to a structure.

Figure 25C:
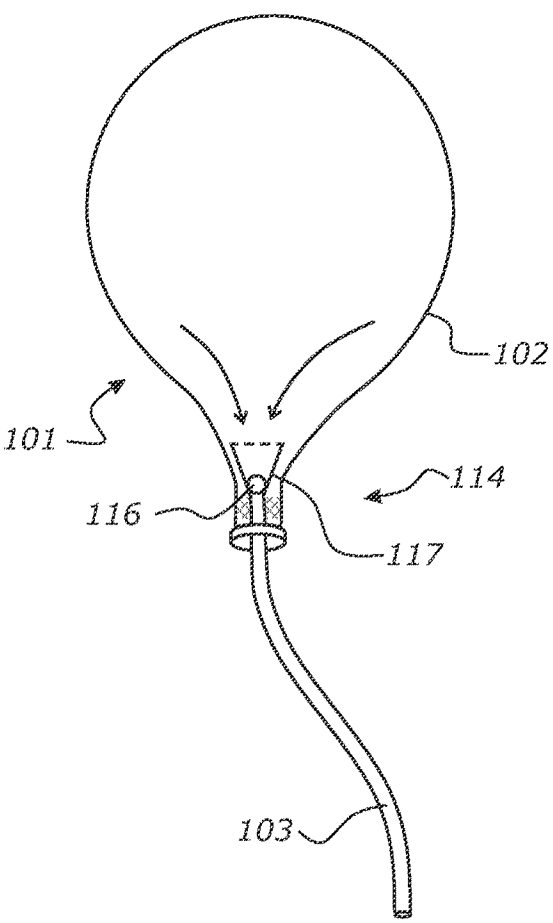
FIGS. 25*a-c* show another embodiment of a balloon and tether assembly.
Figure 25B:
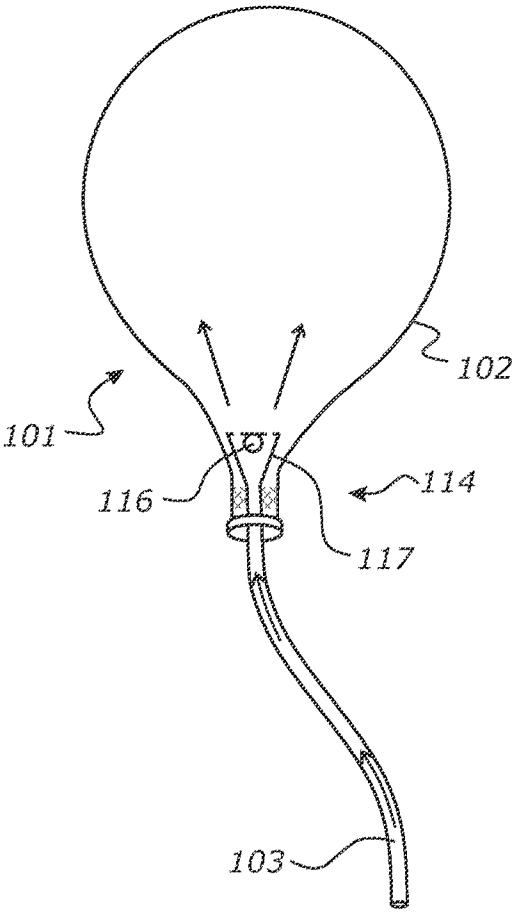
Figure 25A:
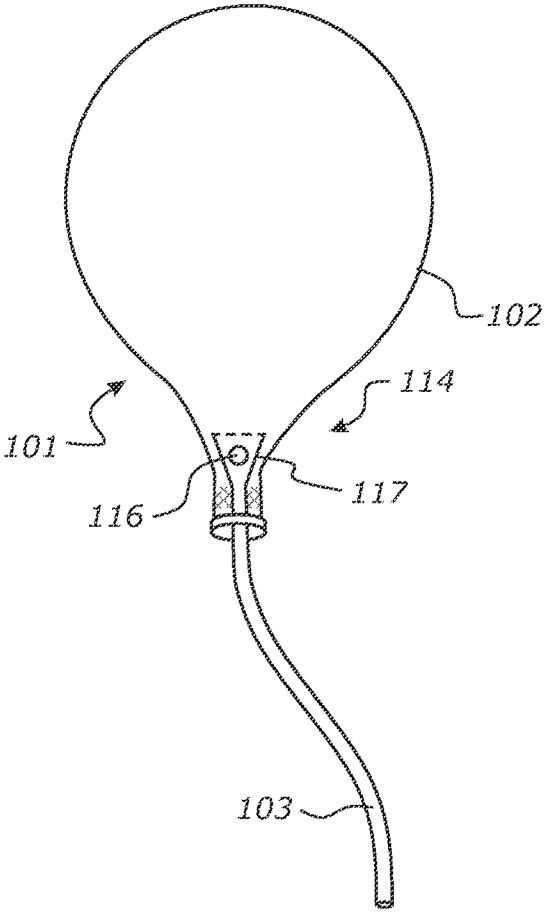

A further embodiment of the balloon and tether assembly 101 is shown in FIGS. 25*a-c*. Seen in FIG. 25*a* is a balloon and tether assembly 101, comprising a balloon 102 and inflation tube 103. The inflation tube 103 is inserted into a spout or neck region 114 of the balloon 102 and the neck is sealed around the inflation tube. Such sealing may for example be by the adhesion of the balloon to itself and the inflation tube, such as with a glue or an ultrasonic weld or other method. Provided at the end of the inflation tube within the balloon is a one-way valve 115. The one-way valve 115 as seen in FIG. 25*a* is in the form of a ball and seat valve comprising a ball 116 and seat 117.

Seen in FIG. 25*b* is the assembly of FIG. 25*a* under a flow of gas through the inflation tube 103. Under pressure of such a flow of gas, the ball 116 may be forced away from association with the narrow portion of the seat 117, allowing the gas to flow around it and into the balloon 102.

Conversely, when the pressure in the inflation tube 103 is less than the pressure in the balloon 102, the ball 116 may be forced into association with the narrow part of the seat 117, sealing the valve and preventing a flow of air from the balloon and through the inflation conduit 103. This is shown in FIG. 25*c*.

In a preferred embodiment the tether or inflation tube has a length longer than its width. As the tether may be used for holding of the balloon assembly or its securing to a support in order to display the balloon, it may be preferable that the tether does not draw attention away from the balloon. In such a configuration it may be desirable to have a ratio of length of the tether to its diameter of between 100 to 1 and 200 to 1. More particularly it may be desirable to have a ratio of the length of the tether to its diameter of approximately 150 to 1.

In order to provide such a ratio and be of a practical length, the tether may be formed having a small diameter. However, decreasing the outer diameter of the tether will also decrease the size of the internal flow passage 51 of the tether. A decrease in the size of the internal flow passage will result in increased resistance to the flow of gas through it. Accordingly, it may be desirable to provide a suitable trade-off between providing a thin, unobtrusive tether and preventing high resistances to flow.

In one embodiment of the invention such a trade-off may be achieved by providing the tether as a tube having an internal diameter of between 2 mm and 4 mm, and an external diameter between 0.1 mm and 1 mm greater than the internal diameter. More particularly, the tube may have an internal diameter of approximately 2.8 mm and an external diameter of approximately 3.5 mm.

In some examples the assembly may be adapted for use as a novelty item or childrens toy, and in such examples it is desirable that the balloons are able to be inflated by a manual pump or by a low powered electric or motorised pump. In such examples it is desirable that inflation of the balloons to a point just ahead of bursting capacity could be achieved within a time frame of between 30 seconds and 3 minutes. In some such examples the tethers may be between 30 cm and 120 cm long, and optionally between 50 cm and 100 cm long. The tethers may have an internal diameter of between 2 mm and 4 mm, and optionally an external diameter between 0.1 mm and 1 mm greater than the internal diameter.

The invention claimed is:

1. A balloon and tether assembly comprising or including:

a plurality of inflatable balloons, each with a spout defining an inflation entrance for the balloon, and a plurality of inflation conduits for delivering inflation gas to said plurality of balloons, each of said inflation conduits extending between a first open end, about which the spout of a respective one of the balloons is sealed, and a second open end;

wherein each inflation conduit has an associated valve to close the conduit and prevent deflation of its associated balloon after inflation, said valve carried by its associated inflation conduit in order to close that inflation conduit independently of the other inflation conduits of the assembly, and wherein each of said inflation conduits is flexible and elongate so as to be able to act as a tether of or for the balloon post-inflation.

2. The assembly of claim 1 wherein each said balloon is bonded to a respective tether at its spout.

3. The assembly of claim 1 wherein each inflation conduit is between 50 cm and 100 cm long.

4. The assembly of claim 3 wherein each inflation conduit has an internal diameter of between 2 and 4 mm.

5. The assembly of claim 1 wherein each valve is located inside of the balloon, at or near the first open end of the inflation conduit.

6. The assembly of claim 1 wherein each valve is a duck bill valve.

7. The assembly of claim 6 wherein the valve is a duckbill valve comprising two plies of material joined with one another to define a sealable passage therethrough, the tether being inserted into the passage with its exterior sealed against the plies or sheets to close off a first end of the passage and to present the first open end of the tether inside the passage, and wherein the passage is able to collapse so as to seal the passage about the first open end of the tether.

8. The assembly of claim 1 wherein said plurality of inflation conduits are directly connected to one another at connection regions of and between adjacent inflation conduits that extend along at least a part or parts of their length.

9. The assembly of claim 8 wherein the plurality of inflation conduits are severably connected to each other.

10. The assembly of claim 8 wherein the plurality of inflation conduits are connected adjacent one another along a portion of their elongate length, the connected inflation conduits being oriented in a ribbon formation with their elongate axes parallel and co-planar relative to one another.

11. The assembly of claim 8 wherein the inflation conduits are connected in a manner that their second open ends are presented adjacent one another.

12. The assembly of claim 1 further comprising a manifold for the delivery of inflation gas, wherein said manifold comprises at least one outlet to receive the second open end of each of the plurality of inflation conduits to facilitate simultaneous inflation of the plurality of balloons.

13. The assembly of claim 12 wherein the second open ends are received at, and emergent from, a common region of the manifold, and are optionally emergent from the manifold in a common direction.

14. A method of providing a plurality of simultaneously inflated balloons, each having a tether, said method comprising or including the steps of:

supplying an inflation gas into a manifold via which a flexible, elongate inflation conduit passing into each balloon receives inflation gas to be delivered to each respective balloon, each of said balloons having a spout region defining an inflation entrance for the balloon which spout region is sealed about a first open end of a respective inflation conduit, and post inflation of each balloon via its inflation conduit, closing each such inflation conduit to prevent deflation of its attached inflated balloon and to leave each such conduit as a said tether of its respective balloon, wherein closing of each inflation conduit is effected by a valve carried by its associated inflation conduit in order to close that inflation conduit independently of the other inflation conduits of the system.

15. The method of claim 14 wherein each inflation conduit is between 50 cm and 100 cm long, and wherein the method further comprises the step of anchoring the balloon to its tether.

16. The method of claim 14 wherein each valve is located inside of the balloon, and wherein the method further comprises the step of sealing or constricting the inflation tube at or near the first open end of the inflation conduit.

17. The method of claim 14 wherein said plurality of inflation conduits are directly connected to one another at connection regions of and between adjacent inflation conduits that extend along at least a part or parts of their length.

18. The method of claim 17 wherein the plurality of inflation conduits are severably connected to each other and wherein the method further comprises the step of severing the connection between the inflation conduits in order to separate them from one another.

19. The method of claim 17 wherein the inflation conduits are connected in a manner that their second open ends are presented adjacent one another.

20. The method of claim 14 wherein said manifold comprises at least one outlet to receive a second open end of each of the plurality of inflation conduits to facilitate supply of inflation gas, and wherein the second open ends are received at, and emergent from, a common region of the manifold, and are optionally emergent from the manifold in a common direction, and wherein the method further comprises the step of engaging a second open end of each of the inflation conduits at the outlet of the manifold prior to supplying inflation gas.

* * * * *